US011040369B2

(12) United States Patent
Dean et al.

(10) Patent No.: US 11,040,369 B2
(45) Date of Patent: Jun. 22, 2021

(54) SIDE-BY-SIDE CARTRIDGE ASSEMBLY FOR DISPENSING A FIRST FLUID AND A SECOND FLUID

(71) Applicant: NORDSON CORPORATION, Westlake, OH (US)

(72) Inventors: Crispin B. Dean, Langebrueck (DE); Anthony R. Martucci, Forked River, NJ (US); Matthew E. Pappalardo, Ewing, NJ (US); Dwayne J. Pulcine, Forked River, NJ (US); Robert W. Springhorn, Cream Ridge, NJ (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 16/080,986

(22) PCT Filed: Mar. 24, 2017

(86) PCT No.: PCT/US2017/023960

§ 371 (c)(1),
(2) Date: Aug. 29, 2018

(87) PCT Pub. No.: WO2017/165730

PCT Pub. Date: Sep. 28, 2017

(65) Prior Publication Data

US 2019/0022694 A1 Jan. 24, 2019

Related U.S. Application Data

(60) Provisional application No. 62/313,533, filed on Mar. 25, 2016.

(51) Int. Cl.
*B05C 17/005* (2006.01)
*B65D 81/32* (2006.01)

(52) U.S. Cl.
CPC .. *B05C 17/00513* (2013.01); *B05C 17/00503* (2013.01); *B05C 17/00553* (2013.01); *B65D 81/325* (2013.01); *B65D 81/3288* (2013.01)

(58) Field of Classification Search
CPC ..... B05C 17/00513; B05C 17/00503; B65D 81/325; B65D 81/3288
(Continued)

(56) References Cited

U.S. PATENT DOCUMENTS 3,269,389 A * 8/1966 Meurer ..... A61M 11/02 128/200.14
4,260,077 A * 4/1981 Schroeder ..... B65D 81/325 222/137

(Continued)

FOREIGN PATENT DOCUMENTS

CN 101466614 A 6/2009
CN 102556516 A 7/2012

(Continued)

OTHER PUBLICATIONS (IPEA/409) International Preliminary Report on Patentability Chapter II or (IB/373) International Preliminary Report on Patentability Chapter I dated Oct. 4, 2018 for WO Application No. PCT/US17/023960.

*Primary Examiner* — Benjamin R Shaw
(74) *Attorney, Agent, or Firm* — BakerHostetler

(57) ABSTRACT

A side-by-side cartridge assembly for dispensing a first fluid and a second fluid includes a first cartridge body and a second cartridge body having first and second cartridge coupling elements, respectively. The first cartridge body extends along an axial direction and has a radial boundary or periphery transverse to the axial direction. The first cartridge has a first neck portion of a neck, and the second cartridge has a second neck portion of the neck. The first neck portion projects from the first cartridge body such that the first neck (Continued)

portion is within the radial boundary or periphery of the first cartridge. As such, the first cartridge coupling element operatively connects to the second cartridge coupling element to secure the first cartridge to the second cartridge and form the neck for discharging a first fluid and a second fluid.

15 Claims, 15 Drawing Sheets

(58) Field of Classification Search
USPC ..... 222/137; 220/23.4
See application file for complete search history.

(56) References Cited

U.S. PATENT DOCUMENTS 4,261,481 A * 4/1981 Speer ..... B01F 5/0645 222/135
4,871,090 A 10/1989 Hoffmann
4,982,881 A * 1/1991 Amrein ..... B67D 7/0288 141/335
5,249,709 A * 10/1993 Duckworth ..... B05C 17/00506 222/137
5,386,928 A * 2/1995 Blette ..... B05C 17/00516 222/94
5,462,205 A * 10/1995 Keller ..... B05C 17/00593 222/145.1
5,762,117 A * 6/1998 Law ..... B65D 25/48 141/198
6,082,588 A * 7/2000 Markey ..... B05B 11/3084 222/135
6,155,464 A * 12/2000 Vachon ..... B67D 7/005 141/291
6,227,419 B1 * 5/2001 Raboin ..... B67D 7/005 222/484
6,435,380 B1 * 8/2002 Raboin ..... B67D 7/005 141/292
6,499,630 B2 * 12/2002 Muhlbauer ..... A61C 9/0026 222/137
6,732,887 B2 * 5/2004 Bills ..... B05C 17/00506 222/137
8,800,826 B2 * 8/2014 Forbis ..... B67D 7/005 222/484
9,227,218 B1 * 1/2016 Lin ..... B65D 81/325
2003/0234061 A1 * 12/2003 Trippi, Jr. ..... B67D 7/005 141/285
2004/0025968 A1 * 2/2004 Allen ..... B67D 7/005 141/351
2005/0092783 A1 * 5/2005 Nielsen ..... B67D 7/005 222/505
2007/0215242 A1 * 9/2007 Bonner ..... B67D 7/42 141/198
2007/0287965 A1 12/2007 Strong et al.
2008/0035240 A1 * 2/2008 Nielsen ..... B67D 7/005 141/351
2008/0099478 A1 * 5/2008 Gleich ..... B65D 81/3288 220/23.2
2010/0308085 A1 * 12/2010 Vachon ..... B67D 7/005 222/484
2011/0198372 A1 * 8/2011 White ..... B67D 7/005 222/482
2012/0104030 A1 5/2012 Springhorn et al.
2014/0097210 A1 * 4/2014 Wright ..... B65D 47/243 222/505
2014/0117041 A1 5/2014 Springhorn
2014/0117044 A1 5/2014 Pappalardo
2014/0117046 A1 * 5/2014 Ettlin ..... B05C 17/01 222/145.5
2014/0203023 A1 7/2014 Ettlin
2015/0114986 A1 4/2015 Ngu et al.
2015/0114995 A1 * 4/2015 DiSiro ..... B05C 17/00513 222/137
2016/0207685 A1 * 7/2016 Stuck ..... B65D 81/3288
2016/0296963 A1 * 10/2016 Dean ..... B65D 81/325
2019/0093823 A1 * 3/2019 Scott ..... B67D 7/78
2019/0144172 A1 * 5/2019 Vachon ..... B65D 25/48 222/481

FOREIGN PATENT DOCUMENTS

CN 103786957 A 5/2014
CN 103786985 A 5/2014
CN 104590759 A 5/2015
CN 104590760 A 5/2015
DE 202006016528 2/2008
EP 2221115 A1 8/2010
JP 3010967 U 5/1995
JP 2004-050008 A 2/2004
JP 2009-528095 A 8/2009
JP 2015-501264 A 1/2015
KR 20-0396507 Y1 9/2005

* cited by examiner

SIDE-BY-SIDE CARTRIDGE ASSEMBLY FOR DISPENSING A FIRST FLUID AND A SECOND FLUID

CROSS-REFERENCE TO RELATED APPLICATION

This application is a U.S. National Stage of International Patent App. PCT/US2017/023960, filed Mar. 24, 2017, which claims the benefit of U.S. Provisional Patent App. No. 62/313,533, filed Mar. 25, 2016, the disclosures of which are hereby incorporated in their entirety.

TECHNICAL FIELD

The present disclosure relates generally to a side-by-side cartridge assembly, and more particularly, to a first cartridge secured against a second cartridge in a side-by-side configuration for dispensing a first fluid and a second fluid.

BACKGROUND

A variety of fluid cartridge systems having multiple component mixing and dispensing devices exist, including those in which the fluid chambers are in a side-by-side configuration. Such cartridges are often placed in a handheld dispensing applicator having one or more movable plungers engaging one or more pistons associated with the fluid chambers to dispense and mix the multiple components from an end of the cartridges. For example, a resin cartridge containing a fluid resin component and an activator cartridge containing a fluid activator component may be selected and loaded into the handheld dispensing applicator for use.

Due to the reaction that occurs between the multiple components, such as the fluid resin and fluid activator components, these components are separately contained within the resin and activator cartridges. The resin and activator cartridges may be manufactured and formed together as a pair to be sealed together with an integral and unitarily formed closure for storage. However, the fluid resin component often has a different shelf life than the fluid activator component such that when one component perishes, the other must simply be discarded out of necessity. Furthermore, permeation of the fluid activator component through the activator cartridge tends to react with the fluid resin component resulting in a shorter shelf life for the pair of products.

In order to improve shelf life and reduce waste, the resin cartridge and the fluid activator cartridge may be formed and stored separately and secured together shortly before use with the dispensing applicator. As such, any permeation of the activator component may occur apart from the resin cartridge for improved shelf life.

While separate cartridges may improve shelf life, the cartridges themselves require additional handling and greater complexity to accommodate such connection. More particularly, each of the component cartridges requires one or more coupling elements that extend radially outward of the remainder of the cartridge. The coupling elements operatively connect for securing the resin cartridge against the activator cartridge. However, the outwardly extending coupling elements tend to catch on equipment and other structures within a manufacturing environment and make storage more difficult. For example, coupling elements that extend outward of the remainder may reduce the amount of available space for storage and also limit the form of delivery for the component cartridge within the manufacturing environment.

Therefore, there is a need for a side-by-side cartridge assembly and method of securing a first cartridge to a second cartridge, such as a resin cartridge and an activator cartridge, for improving storage and delivery availability during use that addresses present challenges and characteristics such as those discussed above.

SUMMARY

An exemplary embodiment of a side-by-side cartridge assembly for dispensing a first fluid and a second fluid includes a first cartridge and a second cartridge. The first cartridge has a first cartridge body and a first neck portion. The first cartridge body extends along an axial direction and has a first chamber configured to contain the first fluid. In addition, the first cartridge body has a radial boundary or periphery. The first neck portion projects from the first cartridge body and is positioned within the radial boundary or periphery. The first neck portion further includes at least a portion of a first outlet passage in fluid communication with said first chamber for discharging the first fluid therefrom. Similarly, the second cartridge has a second cartridge body and a second neck portion. The second cartridge body has a second chamber configured to contain the second fluid. The second neck portion projects from the second cartridge body and includes at least a portion of a second outlet passage in fluid communication with the second chamber for discharging the second fluid therefrom.

Furthermore, the first and second cartridges respectively include a first cartridge coupling element and a second cartridge coupling element. The first and second cartridge coupling elements operatively connect the first cartridge to the second cartridge such that the first neck portion is positioned proximate to the second neck portion. Thereby, the first and second neck portions collectively form at least a portion of a neck for discharging the first and second fluids therethrough.

According to another exemplary embodiment, a cartridge for dispensing a first fluid from a side-by-side cartridge assembly includes a first cartridge body and a first neck portion. The first cartridge body extends along an axial direction and has a first chamber configured to contain the first fluid. In addition, the first cartridge body has a radial boundary or periphery. The first neck portion projects from the first cartridge body and is positioned within the radial boundary or periphery. The first neck portion further includes at least a portion of a first outlet passage in fluid communication with said first chamber for discharging the first fluid therefrom. The cartridge also includes a first cartridge coupling element. The first cartridge coupling element is configured to operatively connect said first cartridge body to a second cartridge body of another cartridge. Thereby, the first neck portion is configured to be positioned proximate to a second neck portion of the other cartridge for collectively forming at least a portion of a neck for discharging the first fluid therethrough.

In use, a first cartridge secures to a second cartridge in side-by-side configuration. The first cartridge includes a first cartridge body extending along an axial direction and a first neck portion. The first cartridge body has a first chamber configured to contain a first fluid, and the first neck portion at least partially defines a first outlet passage in fluid communication with the first chamber. The second cartridge includes a second cartridge body and a second neck portion.

The second cartridge body has a second chamber configured to contain a second fluid, and the second neck portion at least partially defines a second outlet passage in fluid communication with the second chamber. The method includes rolling the first cartridge body at least a full revolution along a surface in order to provide the first cartridge, positioning the first cartridge against the second cartridge to operatively connect the first and second cartridges, and forming a neck having a first neck outlet and a second neck outlet respectively in fluid communication with the first and second chambers. As such, the first and second neck portions at least partially form the neck for discharging the first and second fluid therefrom.

In another use, the first cartridge secures to the second cartridge in a side-by-side configuration for dispensing a first fluid and a second fluid. The first cartridge has a first cartridge body extending along an axial direction and a first neck portion. The first cartridge body has a first chamber configured to contain the first fluid. The first neck portion at least partially defines a first outlet passage in fluid communication with the first chamber. The second cartridge has a second cartridge body and a second neck portion, where the second cartridge body has a second chamber configured to contain the second fluid. The second neck portion at least partially defines a second outlet passage in fluid communication with the second chamber. The method includes positioning the first cartridge against the second cartridge to operatively connect the first cartridge to the second cartridge, and forming a neck having a first neck outlet and a second neck outlet respectively in fluid communication with the first chamber and the second chamber. As such, the first neck portion and the second neck portion at least partially form the neck for discharging the first and second fluids therethrough.

Various additional objectives, advantages, and features of the disclosure will be appreciated from a review of the following detailed description of the illustrative embodiments taken in conjunction with the accompanying drawings.

DETAILED DESCRIPTION

Figure 1:
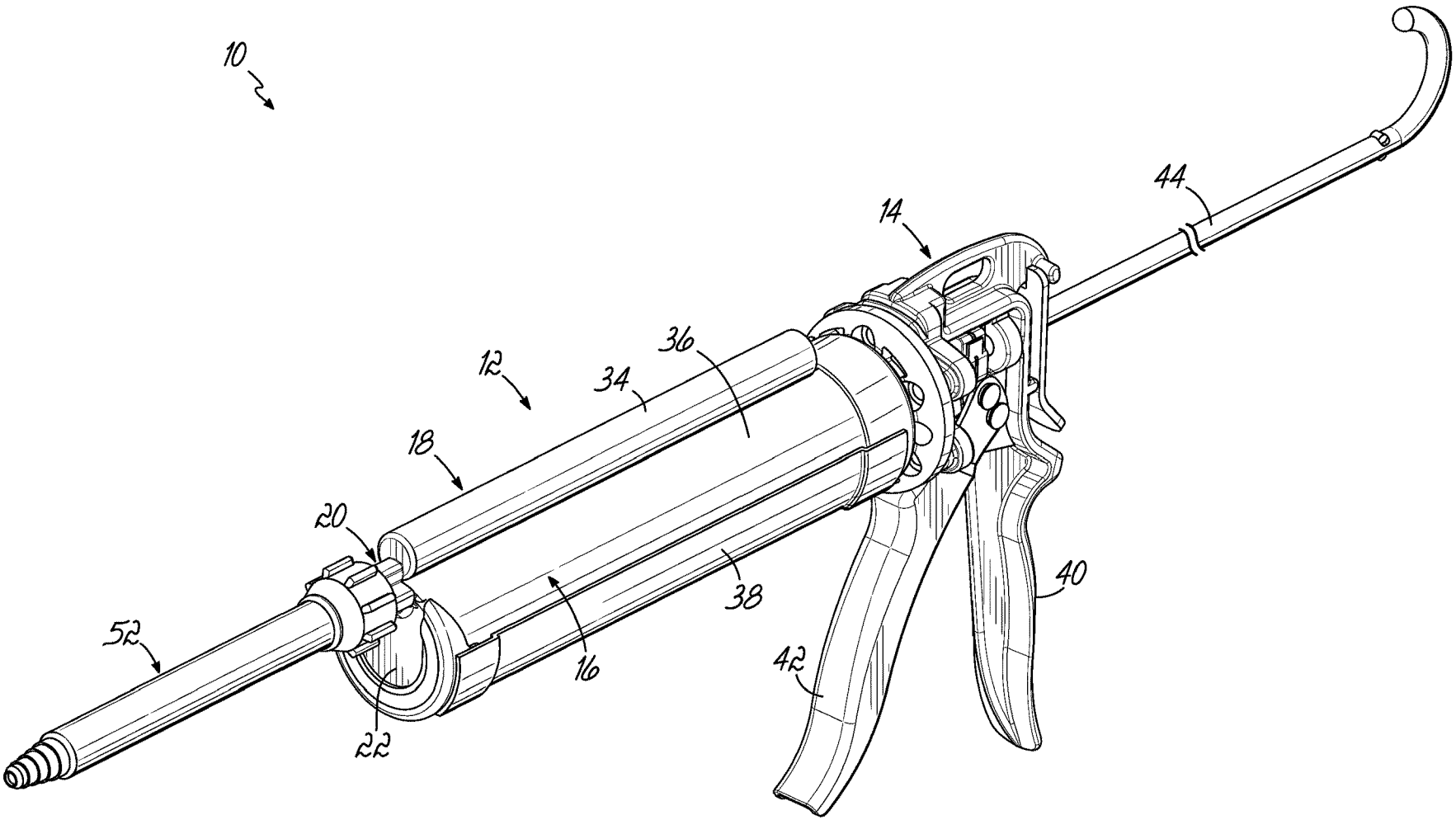
FIG. 1 is a perspective view of a first embodiment of a fluid cartridge system.
Figure 2:
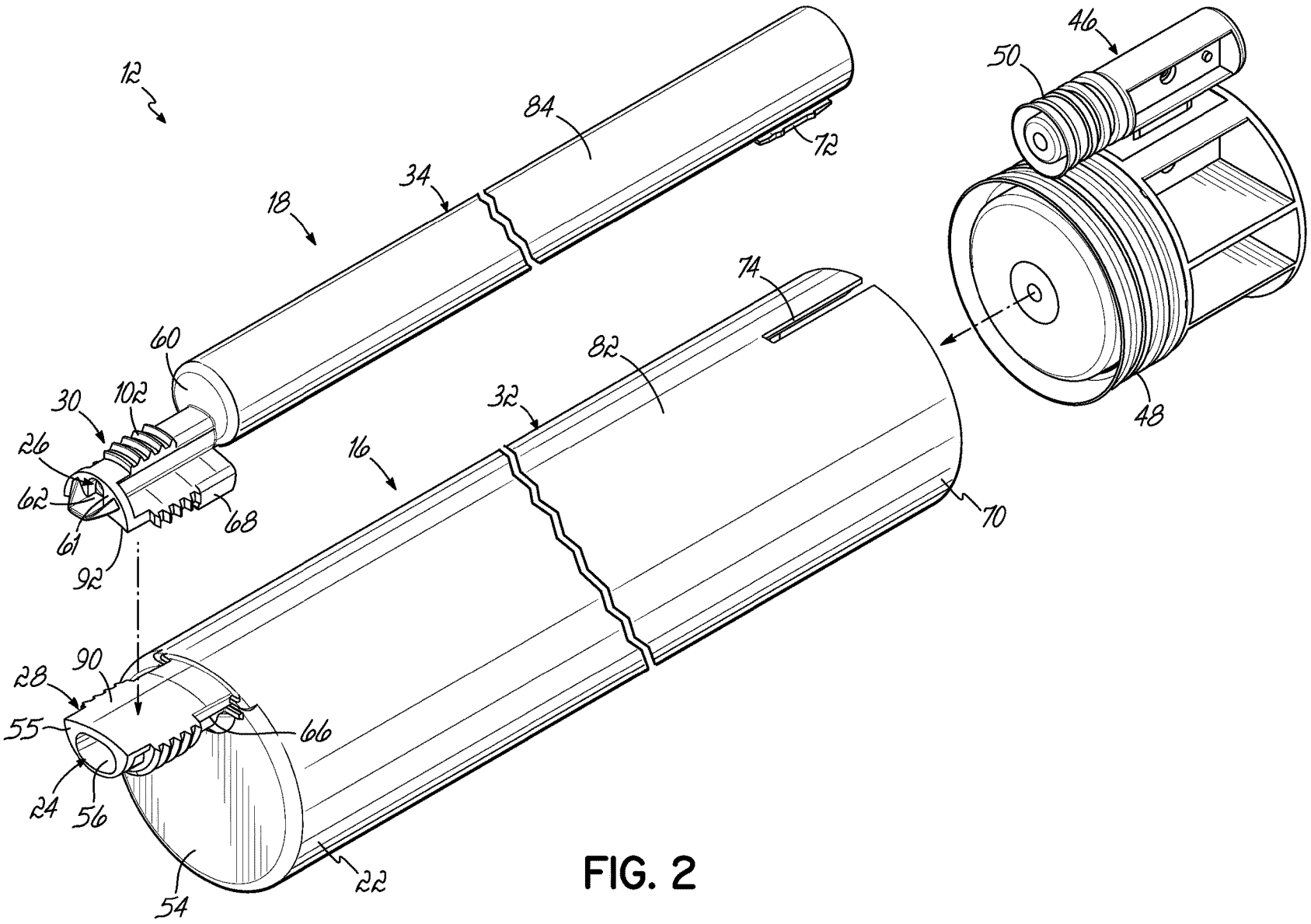
FIG. 2 is a perspective view of a multi-component cartridge assembly shown in FIG. 1.

With reference to FIG. 1 and FIG. 2, a first exemplary embodiment of a fluid cartridge system 10 for dispensing a first fluid and a second fluid includes a side-by-side, multi-component cartridge assembly 12 cradled by a dispensing applicator 14. The multi-component cartridge assembly 12 includes a resin cartridge 16, which contains a fluid resin component, and an activator cartridge 18, which contains a fluid activator component. The resin cartridge 16 is secured against the activator cartridge 18 to collectively form at least a portion of a neck 20 projecting from a proximal end portion 22, also referred to herein as a dispensing end portion 22, of the multi-component cartridge assembly 12. The neck 20 has a resin neck outlet 24 and an activator neck outlet 26 for discharging the fluid resin component and the fluid activator component therefrom, respectively. The neck outlets 24, 26 are offset from respective longitudinal center axes of their respectively associated cartridges 16, 18. The resin and activator cartridges 16, 18 include a resin neck portion 28 and an activator neck portion 30 projecting from the dispensing end portion 22 of a resin cartridge body 32 and an activator cartridge body 34, respectively. The resin cartridge body 32 has a radial boundary or periphery 36 (see FIG. 3B) such that the resin neck portion 28 is positioned within the radial boundary or periphery 36 (see FIG. 3B), such as transversely inward of the radial boundary or periphery 36 (see FIG. 3B). As with the outlets 24, 26, the neck portions 28, 30 are offset from the respective longitudinal center axis of their respectively associated cartridges 16, 18. More specifically, the neck portions 28, 30 extend along their own axes which are offset from the longitudinal center axes of their associated cartridges 16, 18. As such, the resin cartridge 16 may be more easily stored against additional resin cartridges 16 prior to use. As used herein, it will be appreciated that the terms "proximal" and "distal" are intended to provide relative locations along an axial direction of exemplary embodiments of the fluid cartridge system 10. Similarly, it will be appreciated that the terms "outward" and "inward" are intended to provide relative locations along a transverse direction of the exemplary resin and activator cartridges 16, 18.

The dispensing applicator 14 receives the resin and activator cartridges 16, 18 in the side-by-side configuration for use. For example, and as shown in FIG. 1 and FIG. 2, the dispensing applicator 14 includes a cradle 38 for holding the multi-component cartridge assembly 12 and a handle 40 for an operator to grasp. The dispensing applicator 14 further includes a trigger 42 configured to advance an actuator, such as a drive rod 44. The drive rod 44 further advances a piston assembly 46, which includes a resin piston 48 and an activator piston 50 discussed in greater detail with respect to U.S. Pat. No. 8,544,683. The drive rod 44 operatively engages the multi-component cartridge assembly 12 to cause the fluid resin and fluid activator components within the resin and activator cartridges 16, 18 to be dispensed from a nozzle 52 fluidly connected to the neck 20. The nozzle 52 threadably engages the neck 20 and is configured to mix the fluid resin and fluid activator components to form a mixture dispensed on a substrate (not shown). It will be appreciated that the dispensing applicator 14 may be used with alternative embodiments of the multi-component cartridge assemblies also described herein. It will also be appreciated that alternative dispensing applicators and nozzles may be used for dispensing the fluid resin and fluid activator components. As such, the invention is not intended to be limited for use with the dispensing applicator 14. Furthermore, the fluid cartridge system 10 may include one or more closures for fluidly sealing the resin and activator cartridges 16, 18 for storage. By way of example, the fluid cartridge system 10 may include a closure assembly described in additional detail in U.S. Patent App. Pub. No. 2016/0296963, the disclosure of which is hereby incorporated by reference herein.

Figure 3A:
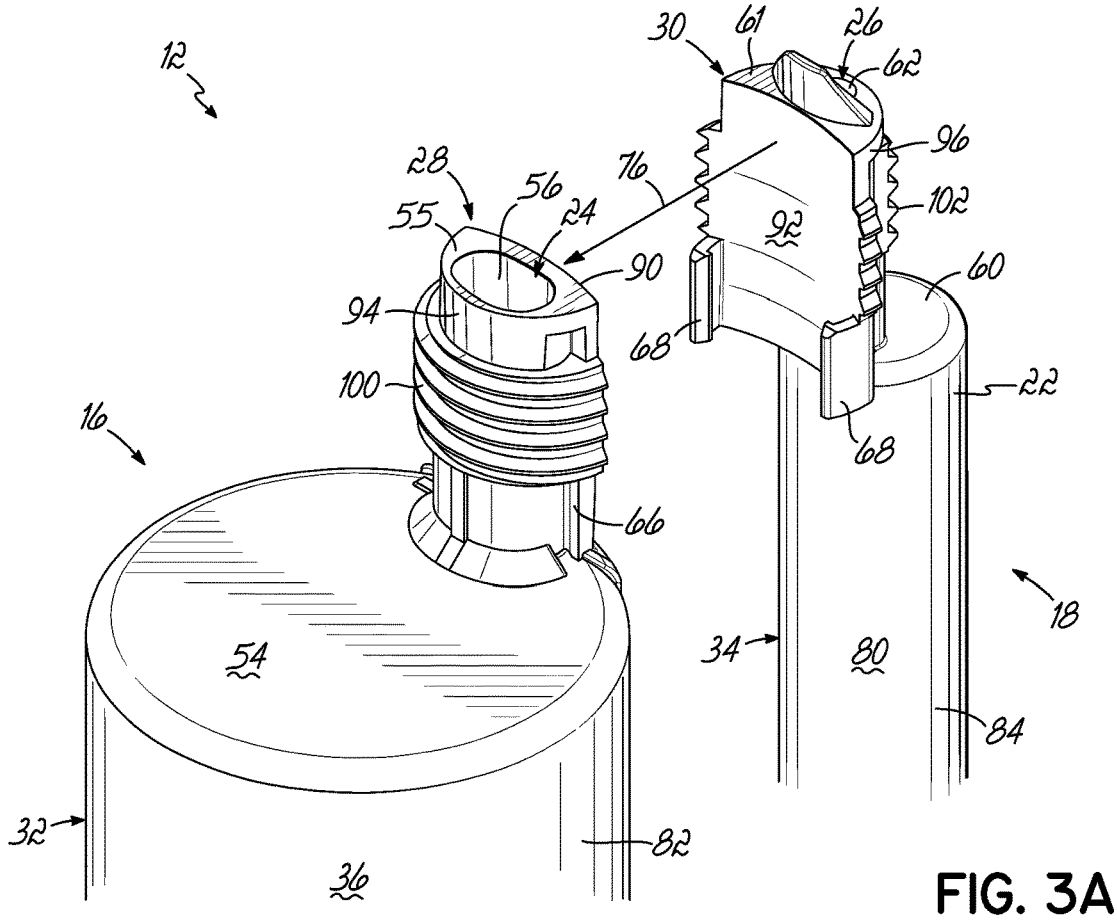
FIG. 3A is an enlarged exploded perspective view of the multi-component cartridge assembly shown in FIG. 2.
Figure 3C:
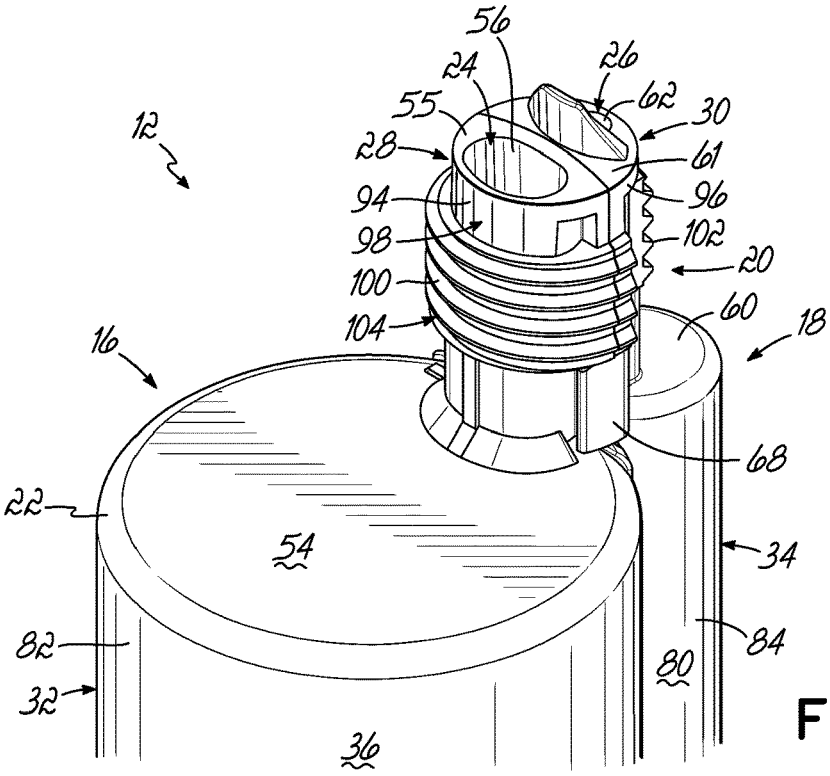
FIG. 3C is an enlarged perspective view of the multi-component cartridge assembly shown in FIG. 2.

With respect to FIGS. 2 through 3C, the resin cartridge 16 includes the resin cartridge body 32 having the resin neck portion 28 extending proximally from a proximal wall 54 of the resin cartridge body 32 to a resin neck end 55. The resin neck portion 28 includes a resin outlet passage 56 that fluidly connects to a resin chamber 58 (see FIG. 7) within the resin cartridge body 32 and further defines the resin neck outlet 24 within the resin neck end 55. Similarly, the activator cartridge 18 includes the activator cartridge body 34 having the activator neck portion 30 extending proximally from a proximal wall 60 of the activator cartridge body 34 to an activator neck end 61. The activator neck portion 30 includes an activator outlet passage 62 that fluidly connects to an activator chamber 64 (see FIG. 7) within the activator cartridge body 34 and further defines the activator neck outlet 26 within the activator neck end 61.

According to the exemplary embodiment of the multi-component cartridge assembly 12, the resin cartridge body 32 secures directly against the activator cartridge body 34 such that the resin and activator cartridge bodies 32, 34 extend generally parallel with each other in the side-by-side configuration. The resin neck portion 28 includes a pair of resin cartridge coupling elements 66 configured to respectively engage a pair of activator cartridge coupling elements 68 of the activator neck portion 30. In addition, a distal end portion 70 of the activator cartridge body 34 includes an activator retaining element 72 configured to engage a resin retaining element 74 for connecting the distal end portion 70 of the resin and activator cartridges 16, 18 together. The operator selectively connects the resin and activator cartridge coupling elements 66, 68 respectively in a transverse direction toward each other, as indicated by arrow 76.

Figure 3B:
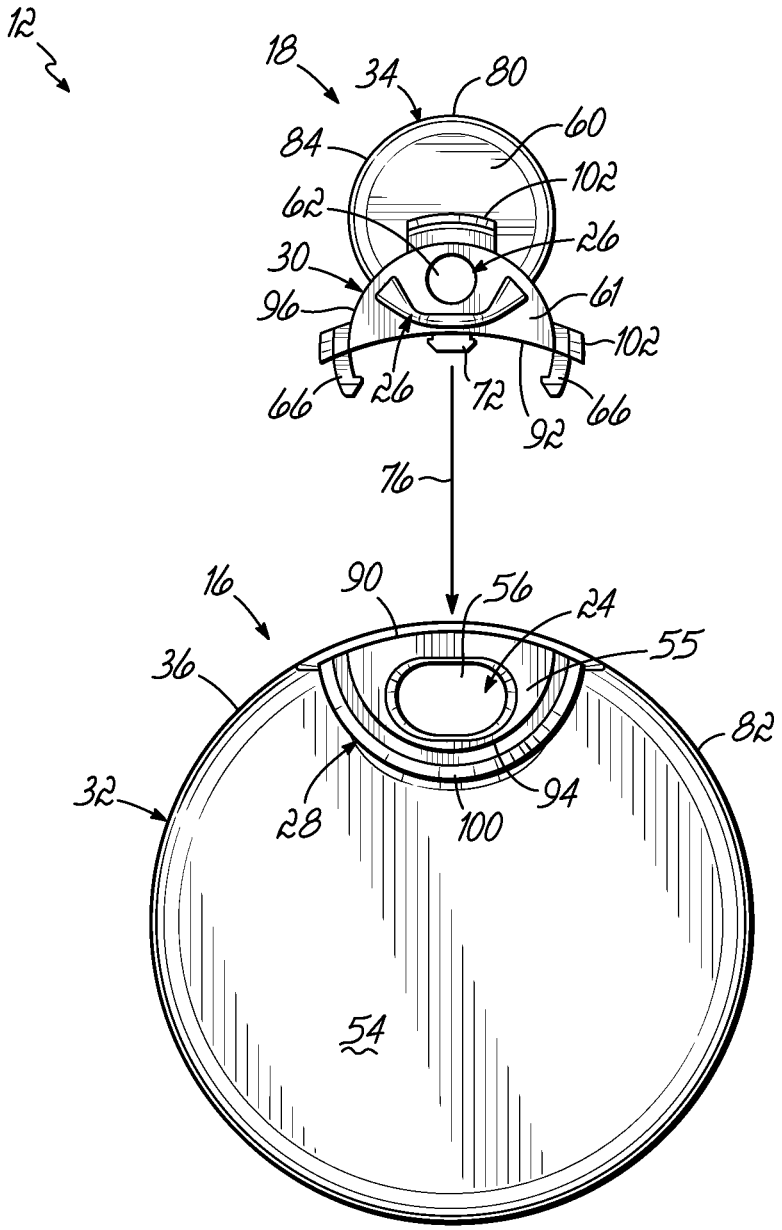
FIG. 3B is a top view of a first cartridge and a second cartridge of the multi-component cartridge assembly shown in FIG. 3A.

With respect to FIG. 3B, the resin cartridge body 32 extends along the axial direction and defines the radial boundary or periphery 36 of the resin cartridge body 32 transverse to the axial direction. The activator cartridge body 34 also extends along the axial direction and defines a radial boundary or periphery 80 of the activator cartridge body 34 transverse to the axial direction. As described herein, the term "radial boundary or periphery" refers to the profiles of the annular sidewalls 82, 84 as viewed along the central, longitudinal axes of the resin and activator cartridge bodies, 32, 34, respectively. The resin and activator cartridge bodies 32, 34 are generally cylindrical in shape and, in turn, the radial boundaries or peripheries 36, 80 are generally circular. The resin neck portion 28 extends in the axial direction from the proximal wall 54 such that the resin neck portion 28 is within the radial boundary or periphery 36 of the resin cartridge body 32, as shown more clearly in FIG. 3B. More particularly, the resin neck portion 28 is positioned inward of the radial boundary or periphery 36. The activator neck portion 30 extends in the axial and transverse direction from the proximal wall 60 such that the activator neck portion 30 projects outwardly beyond the radial boundary or periphery 80. According to the exemplary embodiment, the resin cartridge 16 is generally larger than the activator cartridge 18. However, it will be appreciated that the relative sizes of the cartridges may vary. Preferably, at least one of the cartridge bodies 32 or 34 has the feature of its neck portion 28 or 30 positioned within the radial boundary or periphery 36 or 80. When only one of the cartridge bodies 32, 34 has this feature, it is preferably the larger cartridge body 32.

With the resin neck portion 28 within the radial boundary or periphery 30, a plurality of the resin cartridges 16 may be packed more densely into a storage bin (not shown). In addition, the resin cartridge 16 is further configured to smoothly roll on its annular sidewall 82 in full revolutions along a surface (not shown) for delivering one or more resin cartridges 16 to the operator. For example, a plurality of resin cartridges 16 may be stacked horizontally within a storage bin (not shown) and gravity fed to the operator through an opening in the storage bin (not shown). As used herein, the term "within" in reference to the radial boundary or periphery means that the neck portion overlaps with the radial boundary or periphery and/or is positioned inward of the radial boundary or periphery. For example, a neck portion may be flush with an outer surface of a cartridge sidewall according to another exemplary embodiment and still be considered "within" the radial boundary or periphery as described herein.

The resin neck portion 28 secures against the activator neck portion 30 to form the neck 20, which is a generally cylindrical neck 20. According to the exemplary embodiment, the resin neck end 55 is a minor sector, whereas the activator neck end 61 is a major sector, which forms a circular neck end when the minor sector is positioned against the major sector. The minor and major sectors of the resin and activator neck ends 55, 61 project generally along a length of the neck 20. As such, the resin neck portion 28 has a resin abutment surface 90 held against an activator abutment surface 92 of the activator neck portion 30. The resin abutment surface 90 is convex and positioned inward of the radial boundary or periphery 36. In contrast, the activator abutment surface 92 is concave and extends outward from the radial boundary or periphery 80, toward the radial boundary or periphery 36, and mates against the corresponding resin abutment surface 90. Once mated, the resin and activator neck portions 28, 30 fluidly seal against each other as shown in FIG. 3C to form the neck 20 for receiving the nozzle 52 (see FIG. 1) thereon.

Each of the resin and activator neck portions 28, 30 includes respective resin and activator partial sealing surfaces 94, 96 adjacent to the resin and activator neck ends 55, 61. The resin partial sealing surface 94 is positioned about the resin neck portion 28 opposite the resin abutment surface 90, whereas the activator partial sealing surface 96 is positioned about the activator neck portion 30 opposite the activator abutment surface 92. As the resin and activator neck portions 28, 30 engage each other, the resin and activator partial sealing surfaces 94, 96 meet end to end in order to collectively form an annular sealing surface 98 about an outer surface of the neck 20. In addition, the outer surfaces of the resin and activator neck portions 28, 30 include resin neck threads 100 and activator neck threads 102, respectively. The resin and activator neck threads 100, 102, cooperatively align as the resin neck portion 28 secures against the activator neck portion 30 to form a plurality of threads 104 configured to receive inner threads (not shown) of the nozzle 52 (see FIG. 1). The operator may then thread the nozzle 52 (see FIG. 1) onto the neck 20 and fluidly seal the nozzle 52 (see FIG. 1) against the annular sealing surface 98 for dispensing the fluid resin and fluid activator components.

Figure 4:
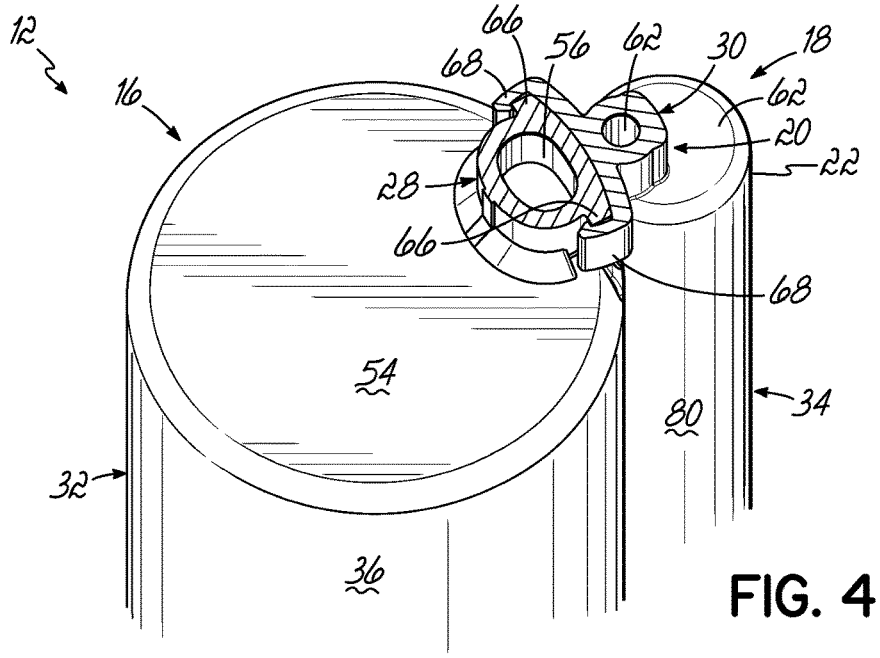
FIG. 4 is an enlarged partially sectioned perspective view of a proximal end portion of the multi-component cartridge assembly.

In order to secure the resin neck portion 28 against the activator neck portion 30 for forming the neck 20 as described above, the operator selectively interlocks the resin cartridge coupling element 66 with the activator cartridge coupling element 68. As shown in FIGS. 3A through 3C, the resin cartridge 16 includes a pair of resin cartridge coupling elements 66 in the form of a pair of resin cartridge grooves 66. The activator cartridge 18 includes a pair of activator cartridge coupling elements 68 in the form of a pair of activator cartridge neck snaps 68. The grooves 66 extend axially and opposite from each other on the outer surface of the resin neck portion 28. Similarly, the neck snaps 68 extend axially and opposite from each other on the activator neck portion 30 and project transversely outward from the resin abutment surface 90. With respect to FIG. 4, the neck snaps 68 are biased in order to wrap about the resin neck portion 28 and snap into the grooves 66, respectively, for securing the resin cartridge 16 to the activator cartridge 18. It will be appreciated that alternative resin and activator cartridge coupling elements 66, 68 may be used for securing the resin cartridge 16 against the activator cartridge 18 in the side-by-side configuration. It will be further appreciated that the alternative resin and activator cartridge coupling elements 66, 68 may also be alternatively positioned on the resin and activator cartridges 16, 18 or even on additional brackets or other mounting structures. Therefore, the invention is not intended to necessarily be limited to one particular form of coupling element.

Figure 5:
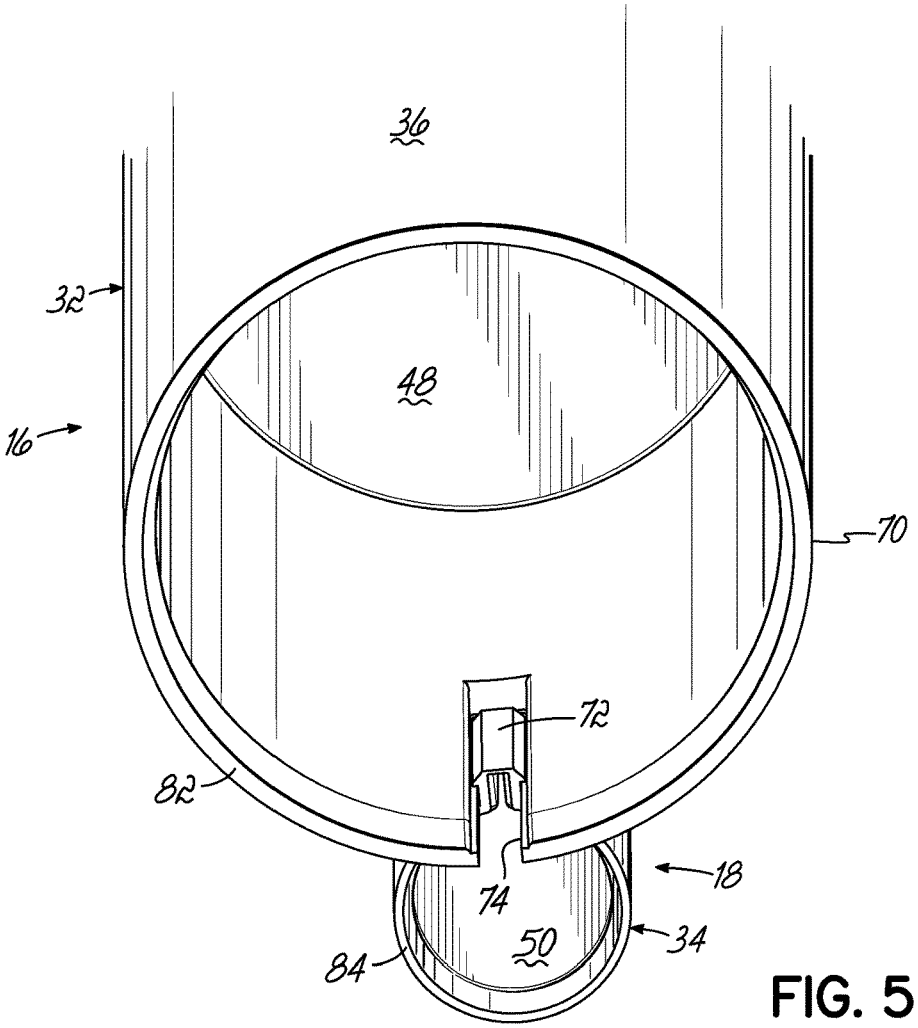
FIG. 5 is an enlarged perspective view of a distal end portion of the multi-component cartridge assembly shown in FIG. 2.

The distal end portion 70 of the resin and activator cartridges 16, 18 secures together by the resin and activator retaining elements 72, 74. The resin retaining element 74 shown in FIG. 5 is an axially extending slot 74 formed in the resin cartridge body 32, and the activator retaining element 72 is an elongated t-shaped tab 72 extending from the activator cartridge body 34. The elongated t-shaped tab 72 fits into the slot 74 such that the elongated t-shaped tab 72 engages the resin cartridge body 32. According to the exemplary embodiment, the elongated t-shaped tab 72 is transversely directed into the slot 74 such that the elongated t-shaped tab 72 snaps into position. Alternatively, the elongated t-shaped tab 72 may be axially inserted into the slot 74.

Figure 6A:
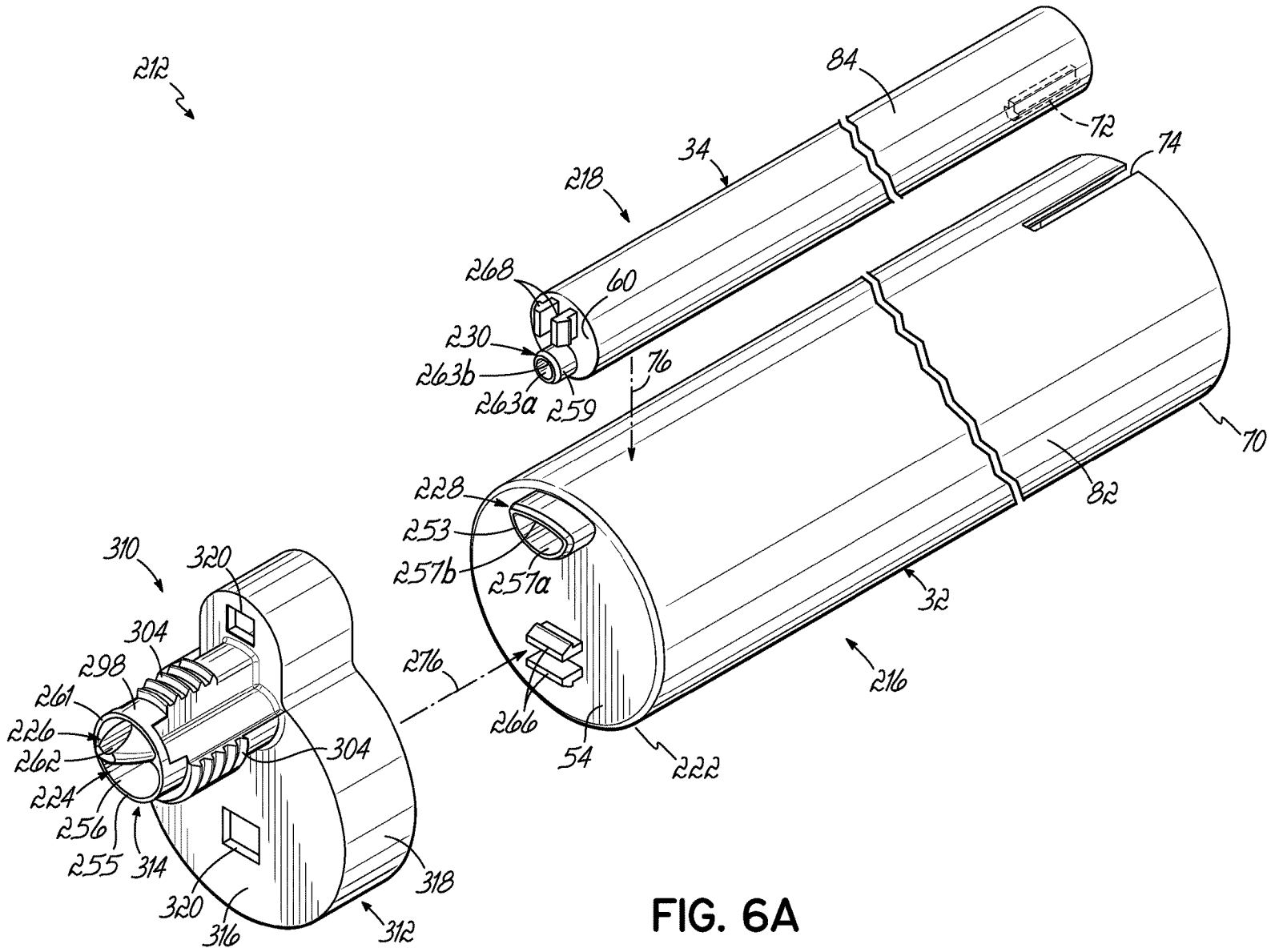
FIG. 6A is an exploded perspective view of a second embodiment of a multi-component cartridge assembly.
Figure 6B:
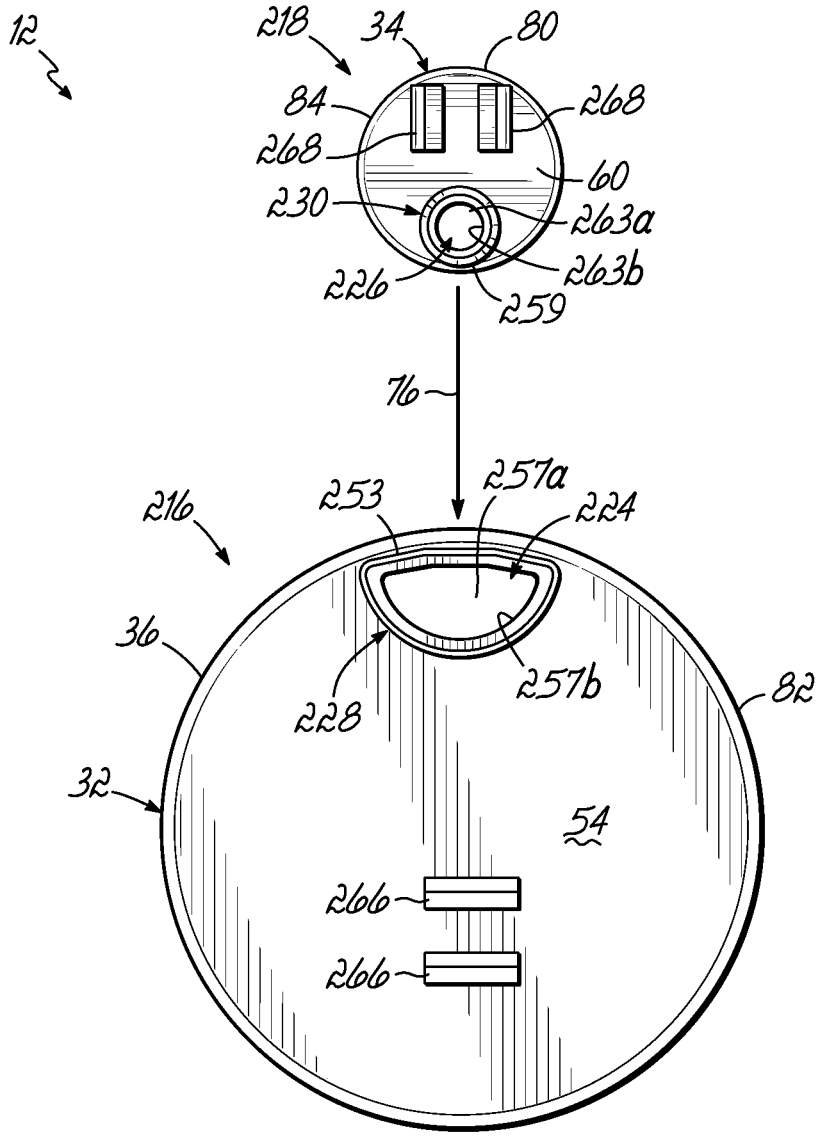
FIG. 6B is a top view of a first cartridge and a second cartridge of the multi-component cartridge assembly shown in FIG. 6A.
Figure 6C:
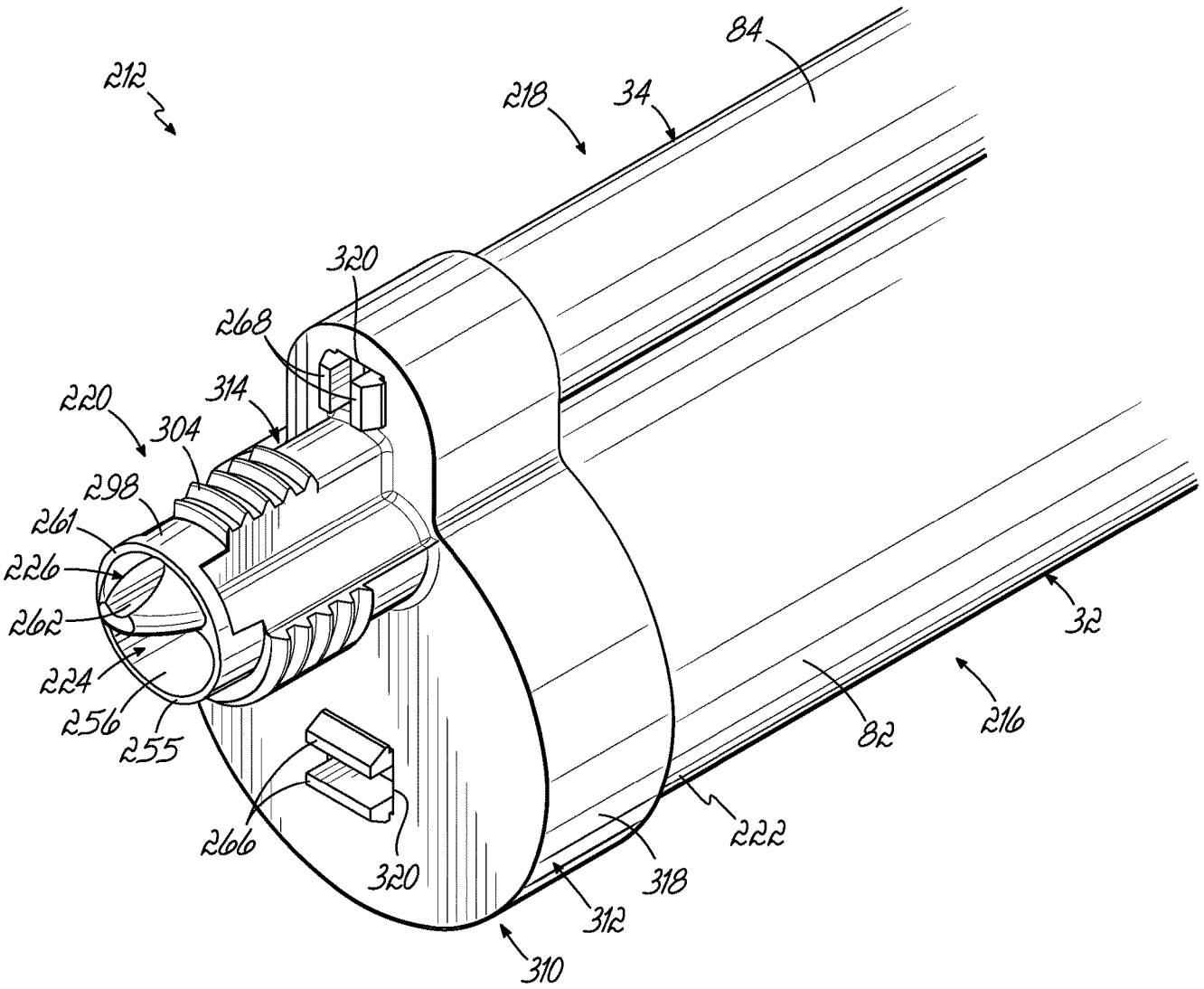
FIG. 6C is an enlarged perspective view of the multi-component cartridge assembly shown in FIG. 6A.
Figure 7:
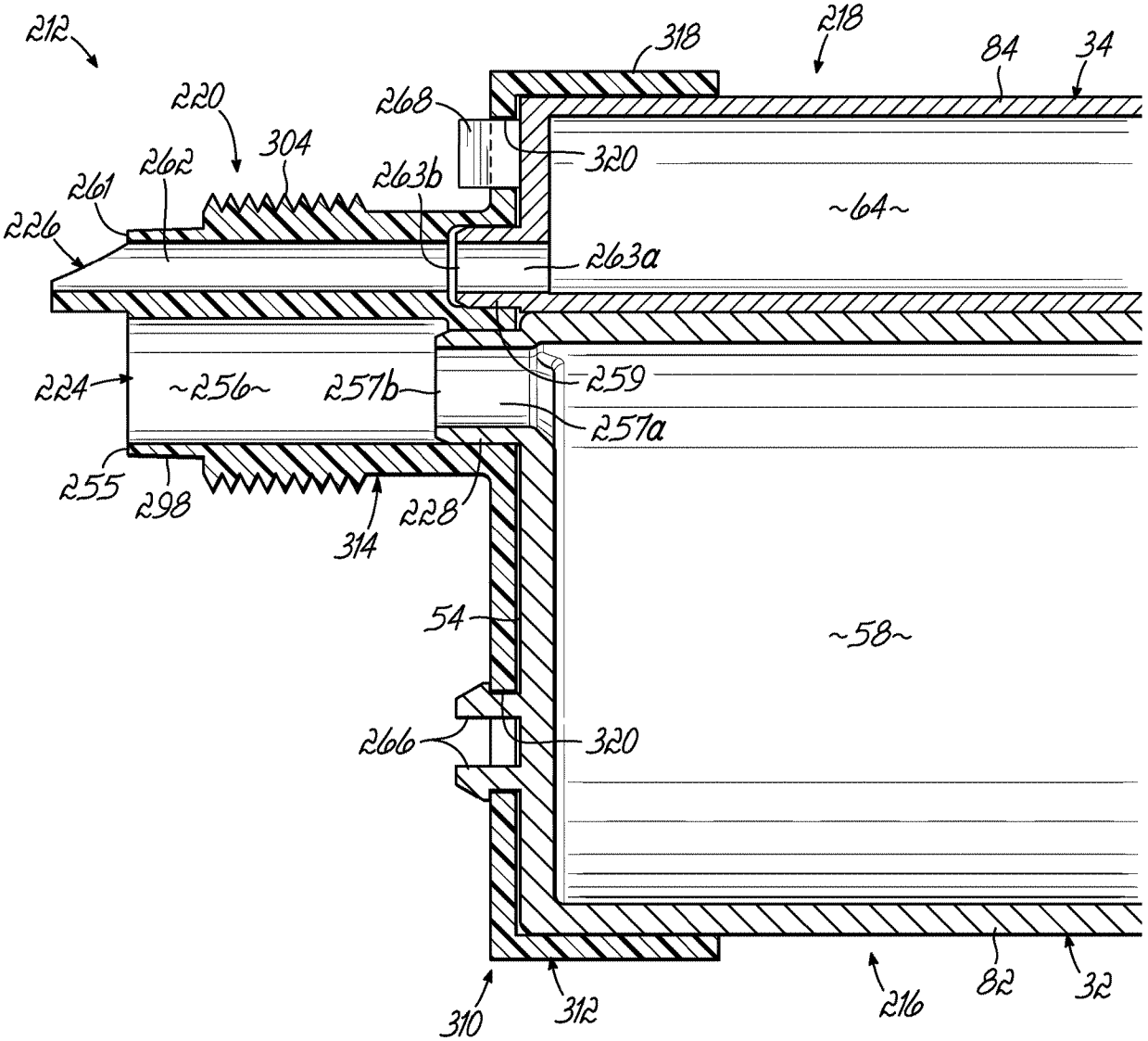
FIG. 7 is an axial cross-section view of the multi-component cartridge assembly shown in FIG. 6C.

With reference to FIGS. 6A through 7, a second exemplary embodiment of a multi-component cartridge assembly 212 for use with the dispensing applicator 14 (see FIG. 1) includes a resin cartridge 216 and an activator cartridge 218. The resin and activator cartridges 216, 218 at least partially form a neck 220 projecting from a dispensing end portion 222 of the multi-component cartridge assembly 212 that includes a resin neck outlet 224 and an activator neck outlet 226. The neck outlets 224, 226 are offset from the longitudinal axes of their respectively associated cartridges 216, 218 as in the first embodiment. In anticipation of dispensing the fluid resin and fluid activator components, the resin and activator cartridges 216, 218 are secured together in the side-by-side configuration with a manifold 310. More particularly, the resin and activator cartridges 216, 218 have respective resin and activator neck portions 228, 230 that, in conjunction with the manifold 310, collectively form the neck 220. As with other embodiments, the neck portions 228, 230 are offset from the longitudinal center axes of their respectively associated cartridges 216, 218. With regard to the first embodiment of the multi-component cartridge assembly 12 (see FIG. 2) and the second embodiment of the multi-component cartridge assembly 212, like numbers below indicate like features also described above.

The manifold 310 includes a cap body 312 and a neck body 314 extending therefrom. The cap body 312 has a dispensing wall 316 and a skirt 318 surrounding the dispensing wall 316 and extending distally therefrom. The skirt 318 receives the dispensing end portion 222 of the resin and activator cartridges 216, 218. The neck body 314 extends proximally from the cap body 312 to a resin neck end 255 and an activator neck end 261. The neck body 314 defines a resin outlet passage 256 and an activator outlet passage 262 for respective fluid communication with the resin chamber 58 and the activator chamber 64. The resin neck end 255 defines the resin neck outlet 224 in fluid communication with the resin outlet passage 256, whereas the activator neck end 261 defines the activator neck outlet 226 in fluid communication with the activator outlet passage 262.

The neck body 314 fluidly connects to the resin and activator neck portions 228, 230. A resin stem 253 extends from the proximal wall 54 of the resin cartridge 216, and an activator stem 259 extends from the proximal wall 60 of the activator cartridge 218. The resin stem 253 defines a resin stem conduit 257*a* extending from the resin chamber 58 to a resin stem outlet 257*b*. The activator stem 259 defines an activator stem conduit 263*a* extending from the activator chamber 64 to an activator stem outlet 263*b*. The resin and activator chambers 58, 64 fluidly connect to the resin and activator neck outlets 224, 226 via the resin and activator stem conduits 257*a*, 263*a*, respectively. As such, the resin and activator stem conduits 257*a*, 263*a* further define the resin and activator outlet passages 256, 262 extending through the neck body 314.

The resin cartridge body 32 secures directly against the activator cartridge body 34 such that the resin cartridge body 32 and the activator cartridge body 34 extend generally parallel with each other in the side-by-side configuration. The proximal wall 54 of the resin cartridge 216 includes a resin cartridge coupling element 266, and the proximal wall 60 of the activator cartridge 218 includes an activator cartridge coupling element 268. Each of the resin and activator cartridge coupling elements 266, 268 engage a respective manifold coupling element 320 associated with the cap body 312. The resin and activator cartridges 216, 218 each connect to the manifold 310 in order to secure the resin cartridge 216 against the activator cartridge 218. In addition, the distal end portion 70 of the activator cartridge body 34 includes the activator retaining element 72 engaging the resin retaining element 74 as described above in additional detail. The operator selectively connects the resin and activator cartridge coupling elements 266, 268 respectively to the manifold coupling elements 320 in an axial direction toward each other, as indicated by arrow 276.

With respect to FIG. 6A and FIG. 6B, the resin and activator cartridge bodies 32, 34 respectively define the radial boundaries or peripheries 36, 80 as discussed above. The resin neck portion 228 extends in the axial direction from the proximal wall 54 such that the resin neck portion 228 is within the radial boundary or periphery 36 as shown more clearly in FIG. 6B. More particularly, the resin neck portion 228 is positioned inward of the radial boundary or periphery 36. Similarly, the activator neck portion 230 extends in the axial direction from the proximal wall 60 such that the activator neck portion 30 is within the radial boundary or periphery 80. More particularly, the activator neck portion 230 is positioned inward of the radial boundary or periphery 80. As such, a plurality of the resin cartridges 216 and a plurality of the activator cartridges 218 may each be packed more densely into separate storage bins (not shown) and/or smoothly roll as described herein.

The resin and activator stems 253, 259 fluidly connect to the neck body 314 to form the neck 220 as shown in FIG. 6C. The resin and activator neck ends 255, 261 are integral and unitarily formed with the neck body 314 for connecting to the nozzle 52 (see FIG. 1). An annular sealing surface 298 circumscribes the outer surface of the neck body 314 adjacent to the resin and activator neck ends 255, 261. The annular sealing surface 298 seals against the inner surface of the nozzle 52 (see FIG. 1). In addition, the neck body 314 further includes neck threads 304 that receive the nozzle 52 (see FIG. 1). The nozzle 52 (see FIG. 1) attaches to the neck 220 and fluidly seals against the annular sealing surface 298 for dispensing the fluid resin and fluid activator components.

In order to secure the resin and activator stems 253, 259 against the manifold 310, the operator selectively interlocks the resin and activator cartridge coupling elements 266, 268 with the manifold coupling elements 320. As shown in FIGS. 6A through 7, the resin cartridge 216 includes a pair of resin cartridge coupling elements 266 in the form of a pair of resin wall clips 266. The resin wall clips 266 extend proximally from the proximal wall 54 of the resin cartridge 216. Similarly, the activator cartridge 218 includes a pair of activator cartridge coupling elements 268 in the form of another pair of activator wall clips 268 that extend proximally from the proximal wall 60 of the activator cartridge 218. The resin and activator wall clips 266, 268 interlock with the manifold coupling elements 320, which are in the form of cap apertures 320 extending through the dispensing wall 316 of the cap body 312. The cap apertures 320 respectively receive the pair of resin and activator wall clips 266, 268 such that the resin and activator wall clips 266, 268 interlock with the dispensing wall 316 of the cap body 312. The resin and activator wall clips 266, 268 resiliently bend in order to snap into the cap apertures 320. It will be appreciated that alternative resin and activator cartridge coupling elements 266, 268 and the manifold coupling elements 320 may be used for securing the resin cartridge 216 against the activator cartridge 218 in the side-by-side configuration.

Figure 8A:
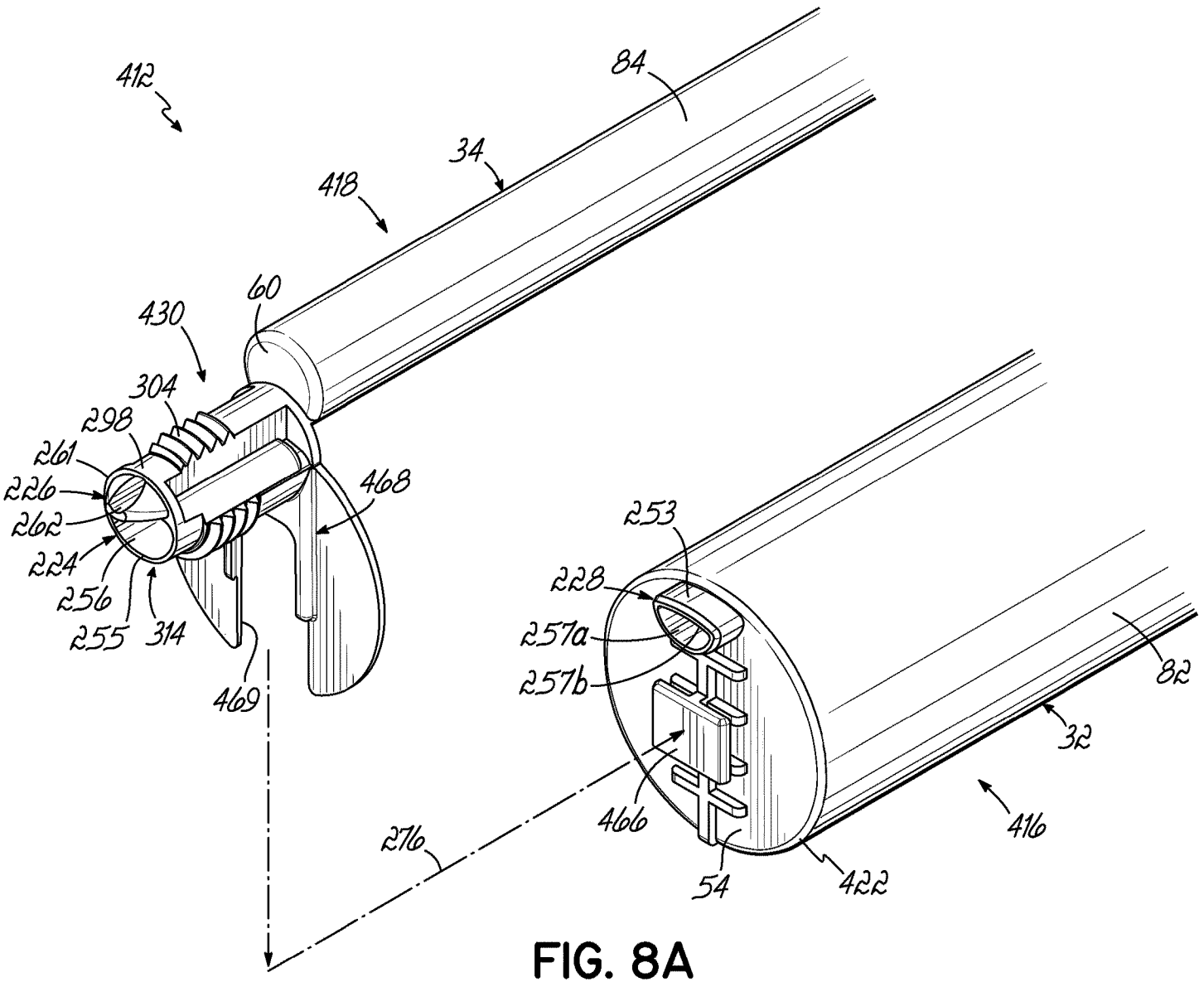
FIG. 8A is an exploded perspective view of a third embodiment of a multi-component cartridge assembly.
Figure 8C:
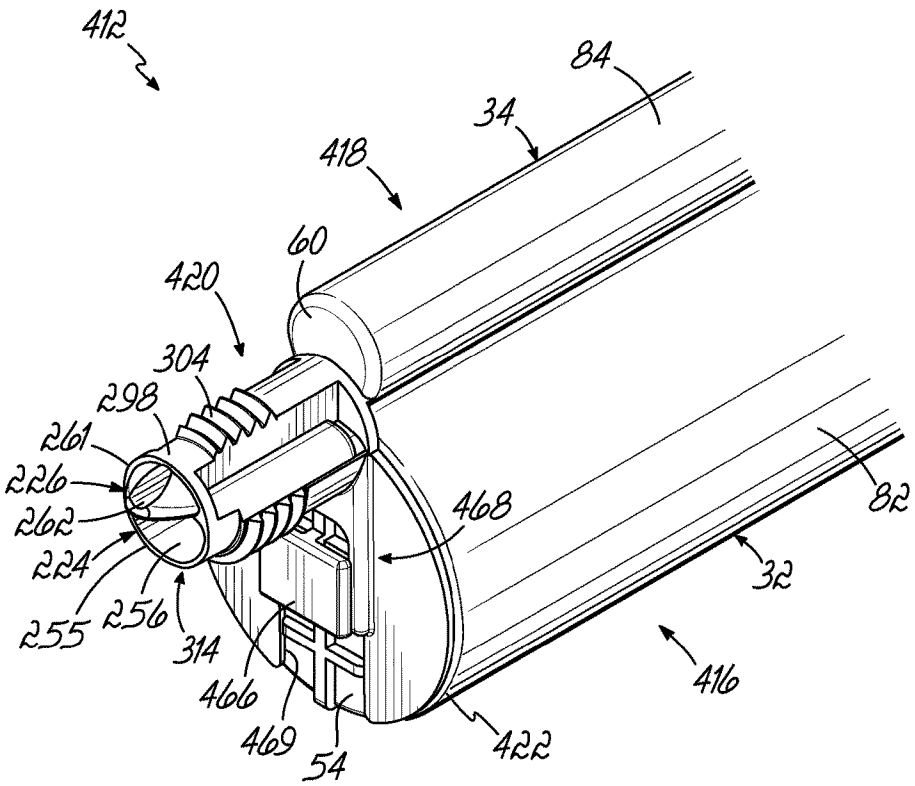
FIG. 8C is an enlarged perspective view of the multi-component cartridge assembly shown in FIG. 8A.
Figure 8B:
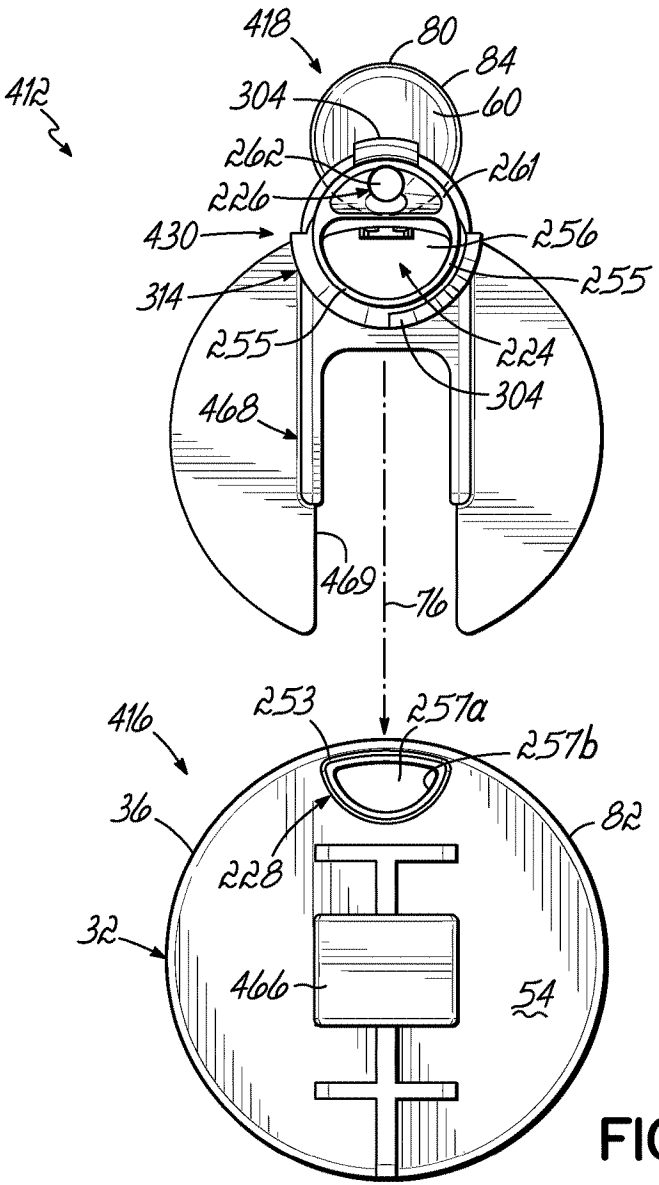
FIG. 8B is a top view of a first cartridge and a second cartridge of the multi-component cartridge assembly shown in FIG. 8A.

With reference to FIGS. 8A through 8C, a third exemplary embodiment of multi-component cartridge assembly 412 for use with the dispensing applicator 14 (see FIG. 1) includes a resin cartridge 416 and an activator cartridge 418. The resin and activator cartridges 416, 418 form a neck 420 (FIG. 8C) projecting from a dispensing end portion 422 of the multi-component cartridge assembly 412. The neck 420 includes the resin neck outlet 224 and the activator neck outlet 226. In anticipation of dispensing the fluid resin and fluid activator components, the resin cartridge 416 secures against the activator cartridge 418 in the side-by-side configuration. The resin and activator cartridges 416, 418 have respective resin and activator neck portions 228, 430 that collectively form the neck 420. As with other embodiments, the neck portions 228, 430 are each offset from the longitudinal axes of their respectively associated cartridges 416, 418. With regard to the first embodiment of the multi-component cartridge assembly 12 (see FIG. 2), the second embodiment of the multi-component cartridge assembly 212 (see FIG. 6A), and the third embodiment of the multi-component cartridge assembly 412, like numbers below indicate like features also described above.

The resin cartridge 416 includes the resin neck portion 228 having the resin stem 253 extending from the proximal wall 54 of the resin cartridge 416. The activator cartridge 418 includes the activator neck portion 428 having a neck body 314 extending therefrom. Specifically, the neck body 314 extends proximally from the proximal wall 60 of the activator cartridge 418 to the resin neck end 255 and the activator neck end 261. The neck body 314 defines the resin outlet passage 256 and the activator outlet passage 262 for respective fluid communication with the resin chamber 58 (see FIG. 7) and the activator chamber 64 (see FIG. 7). The resin neck end 255 defines the resin neck outlet 224 in fluid communication with the resin outlet passage 256, whereas the activator neck end 261 defines the activator neck outlet 226 in fluid communication with the activator outlet passage 262.

The neck body 314 fluidly connects to the resin stem 253 for fluid communication therethrough. The resin stem 253 defines the resin stem conduit 257*a* extending from the resin chamber 58 (see FIG. 7) to the resin stem outlet 257*b*. The resin stem outlet 257*b* is offset from the longitudinal axis of the cartridge 416, and likewise the outlets 224, 226 are each offset from the longitudinal axis of their associated cartridge 418. As such, the resin stem conduit 257*a* further defines the resin outlet passage 256 as described above.

The resin cartridge body 32 secures directly against the activator cartridge body 34 such that the resin and activator cartridge bodies 32, 34 extend generally parallel with each other in the side-by-side configuration. The proximal wall 54 of the resin cartridge 416 includes a resin cartridge coupling element 466. The activator cartridge 418 also includes an activator cartridge coupling element 468 positioned at the dispensing end portion 422. The resin cartridge coupling element 466 connects to the activator cartridge coupling elements 468 in order to secure the resin cartridge 416 against the activator cartridge 418. In addition, the distal end portion 70 (see FIG. 6A) of the activator cartridge body 34 includes the activator retaining element 72 (see FIG. 6A) that engages the resin retaining element 74 (see FIG. 6A) as described above in additional detail. The operator selectively connects the resin and activator cartridge coupling elements 466, 468 in an axial direction toward each other, as indicated by arrow 276.

With respect to FIG. 8A and FIG. 8B, the resin and activator cartridge bodies 32, 34 respectively define the radial boundaries or peripheries 36, 80 as discussed above. The resin neck portion 228 extends in the axial direction from the proximal wall 54 such that the resin neck portion 228 is within the radial boundary or periphery 36 as shown more clearly in FIG. 8B. As such, a plurality of the resin cartridges 416 may be packed more densely into a storage bin (not shown) and/or smoothly roll as described herein.

The resin stem 253 fluidly connects to the neck body 314 to form the neck 420 as shown in FIG. 8C. According to the exemplary embodiment, the resin and activator neck ends 255, 261 are integral and unitarily formed with the neck body 314 for connecting to the nozzle 52 (see FIG. 1). The annular sealing surface 298 seals against the inner surface of the nozzle 52 (see FIG. 1). In addition, the neck body 314 further includes the neck threads 304 for receiving the nozzle 52 (see FIG. 1) and dispensing the fluid resin and fluid activator components.

In order to secure the resin stem 253 against the neck body 314, the operator selectively interlocks the resin cartridge coupling element 466 with the activator cartridge coupling element 468. According to the exemplary embodiment shown in FIGS. 8A through 8C, the resin cartridge 416 includes the resin cartridge coupling element 466 in the form of a widened t-shaped tab 466 extending proximally from the proximal wall 54. In addition, the activator cartridge coupling element 468 is in the form of a cantilevered wall 468 extending generally transversely from the neck body 314 and having a slot 469 extending therethrough. The slot 469 is configured to receive the widened t-shaped tab 466 such that the widened t-shaped tab 466 interlocks with the cantilevered wall 468 of the activator neck portion 430. The widened t-shaped tab 466 and/or the cantilevered wall 468 resiliently bend in order to snap the widened t-shaped tab 466 into the slot 469. It will be appreciated that alternative resin and activator cartridge coupling elements 466, 468 may be used for securing the resin cartridge 416 against the activator cartridge 418 in the side-by-side configuration.

With reference to FIGS. 9A through 11, a fourth exemplary embodiment of a multi-component cartridge assembly 612 for use with the dispensing applicator 14 (see FIG. 1) includes a resin cartridge 616 and an activator cartridge 618. The resin and activator cartridges 616, 618 form a neck 620 projecting from a dispensing end portion 622 of the multi-component cartridge assembly 612. The neck 620 includes the resin neck outlet 224 and the activator neck outlet 226. In anticipation of dispensing the fluid resin and fluid activator components, the resin cartridge 616 secures against the activator cartridges 618 in the side-by-side configuration. The resin and activator cartridges 616, 618 have respective resin and activator neck portions 628, 630 that collectively form the neck 620. With regard to the first embodiment of the multi-component cartridge assembly 612 (see FIG. 2), the second embodiment of the multi-component cartridge assembly 212 (see FIG. 6A), the third embodiment of the multi-component cartridge assembly 412 (see FIG. 8A), and the fourth embodiment of the multi-component cartridge assembly 612, like numbers below indicate like features also described above.

The resin cartridge 616 includes a resin cartridge body 632 and the activator cartridge 618 includes an activator cartridge body 634. The resin neck portion 628 projects proximally from the resin cartridge body 632 such that the resin neck portion 628 is positioned inward of the radial boundary or periphery 36 of the resin cartridge body 632. In contrast, the activator neck portion 630 projects outward from the activator cartridge body 634 beyond the radial boundary or periphery 80. As such, the activator neck portion 630 projects in the transverse direction relative to the resin neck portion 628 in order to extend to and fluidly connect with the resin neck portion 628.

The resin cartridge body 632 has an annular sidewall 682 extending to a proximal wall 654. The resin neck portion 628 includes a neck body 714 extending from the proximal wall 654 of the resin cartridge 616 to the resin neck end 255 and the activator neck end 261. The neck body 714 defines a resin outlet passage 656 and an activator outlet passage 662 for respective fluid communication with a resin chamber 658 and an activator chamber 664. The resin neck end 255 defines the resin neck outlet 224 in fluid communication with the resin outlet passage 656, whereas the activator neck end 261 defines the activator neck outlet 226 in fluid communication with the activator outlet passage 662.

With respect to the resin cartridge 616, the activator outlet passage 662 projects distally from the activator neck outlet 226 to a transversely extending portion of the activator outlet passage 662, which fluidly connects to an activator neck inlet 665. The activator neck inlet 665 extends through the annular sidewall 682 and into the proximal wall 654 for fluid communication with the activator outlet passage 662.

The activator cartridge body 634 has an annular sidewall 684 extending to a proximal wall 660. The activator neck portion 630 includes an activator stem 659 extending from the annular sidewall 684 and positioned proximate to the proximal wall 654. The activator neck inlet 665 receives the activator stem 659 and fluidly connects the neck body 714 to the activator stem 659 for fluid communication therethrough. The activator stem 659 defines an activator stem conduit 663*a* extending from the activator chamber 664 to an activator stem outlet 663*b*.

The resin cartridge body 632 secures directly against the activator cartridge body 634 such that the resin cartridge body 632 and the activator cartridge body 634 extend generally parallel with each other in the side-by-side configuration. The proximal wall 654 of the resin cartridge 616 includes a resin cartridge coupling element 666, and the dispensing end portion 622 of the activator cartridge 618 includes an activator cartridge coupling element 668. The activator cartridge coupling element 668 extends from the annular sidewall 684 of the activator cartridge body 634 toward the annular sidewall 682 of the resin cartridge body 632. The resin cartridge coupling element 666 and the activator cartridge coupling elements 668 connect in order to secure the resin cartridge 616 against the activator cartridge 618.

In addition, a distal end portion 670 of the activator cartridge body 634 includes an activator retaining element 672 configured to engage a resin retaining element 674 for further securing the resin cartridge 616 against the activator cartridge 618. The distal end portion 670 includes a pair of activator retaining elements 672 in the form of a pair of elongated retaining clips 672. The retaining clips 672 are generally parallel and offset from each other and extend from the distal end portion 670 toward the resin retaining element 674. The resin retaining element 674 is in the form of a widened slot 674. The widened slot 674 receives the pair of retaining clips 672 such that the retaining clips 672 interlock with the distal end portion 670 of the activator cartridge body 634. The operator selectively connects the resin and activator cartridge coupling elements 666, 668 and the resin and activator retaining elements 672, 674 in a transverse direction toward each other, as indicated by arrow 676.

Figure 9A:
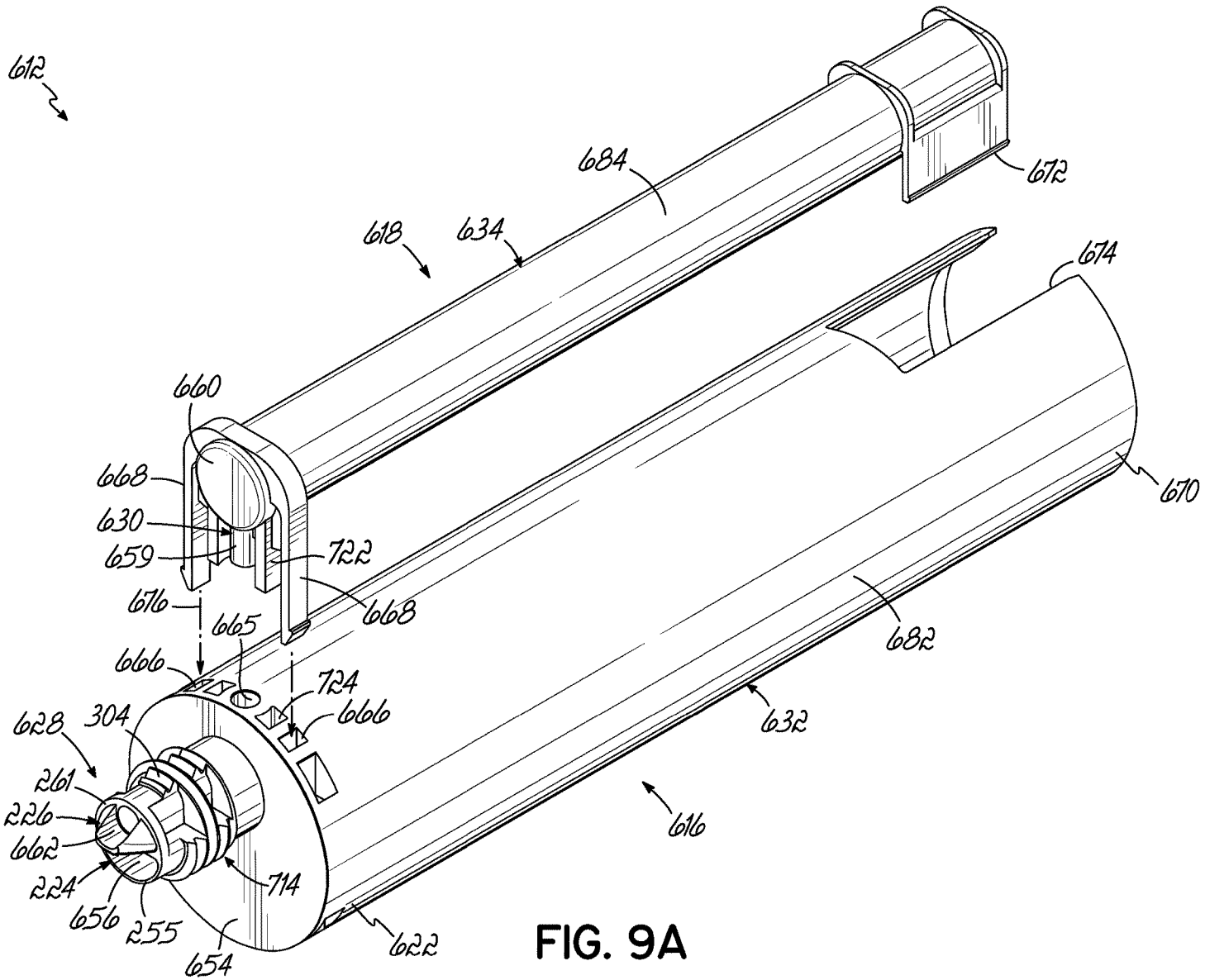
FIG. 9A is an exploded perspective view of a fourth embodiment of a multi-component cartridge assembly.
Figure 9B:
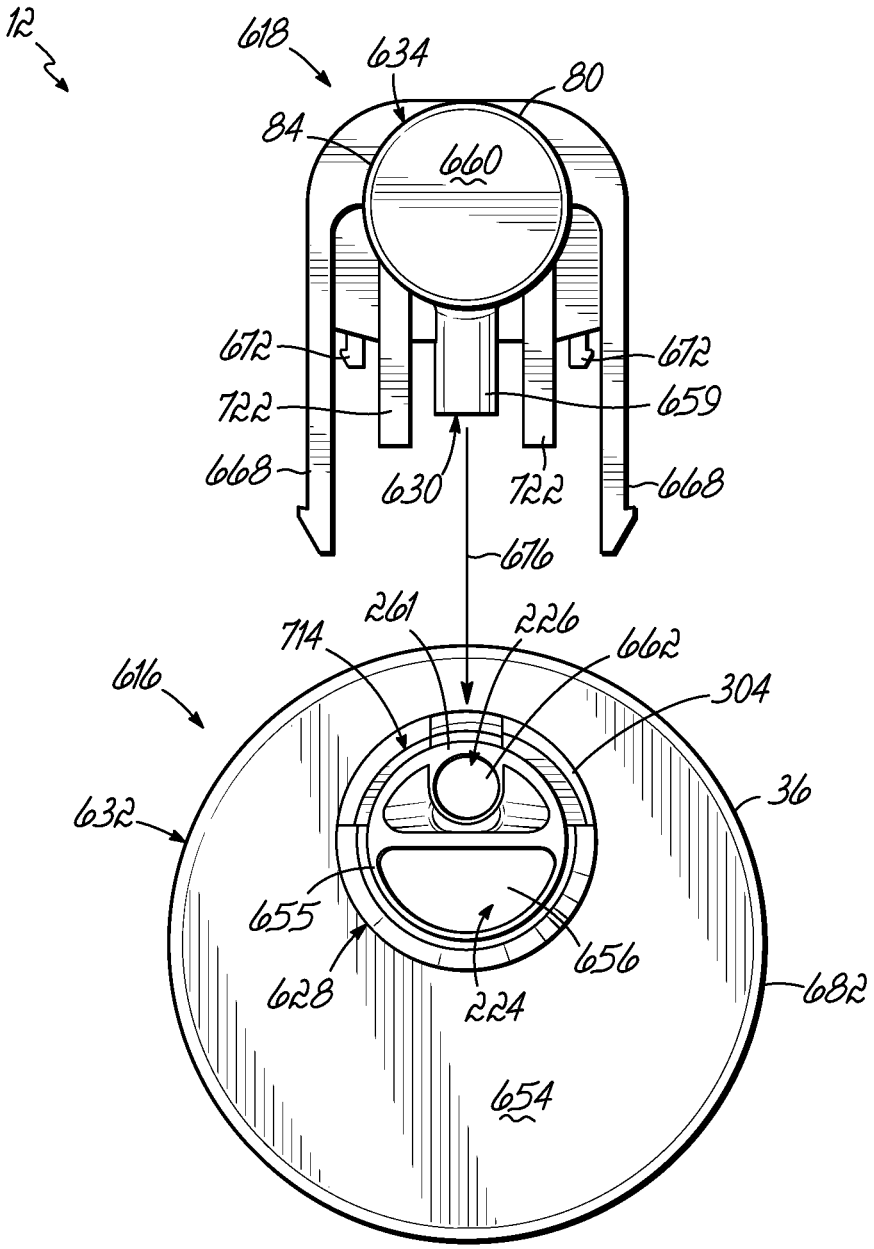
FIG. 9B is a top view of a first cartridge and a second cartridge of the multi-component cartridge assembly shown in FIG. 9A.

With respect to FIG. 9A and FIG. 9B, the resin and activator cartridge bodies 632, 634 respectively define the radial boundaries or peripheries 36, 80, as discussed above. The resin neck portion 628 extends in the axial direction from the proximal wall 654 such that the resin neck portion 628 is within the radial boundary or periphery 36 as shown more clearly in FIG. 9B. As such, a plurality of the resin cartridges 616 may be packed more densely into a storage bin (not shown), roll-fed into a filling machine (not shown), and/or smoothly roll as described herein.

Figure 9C:
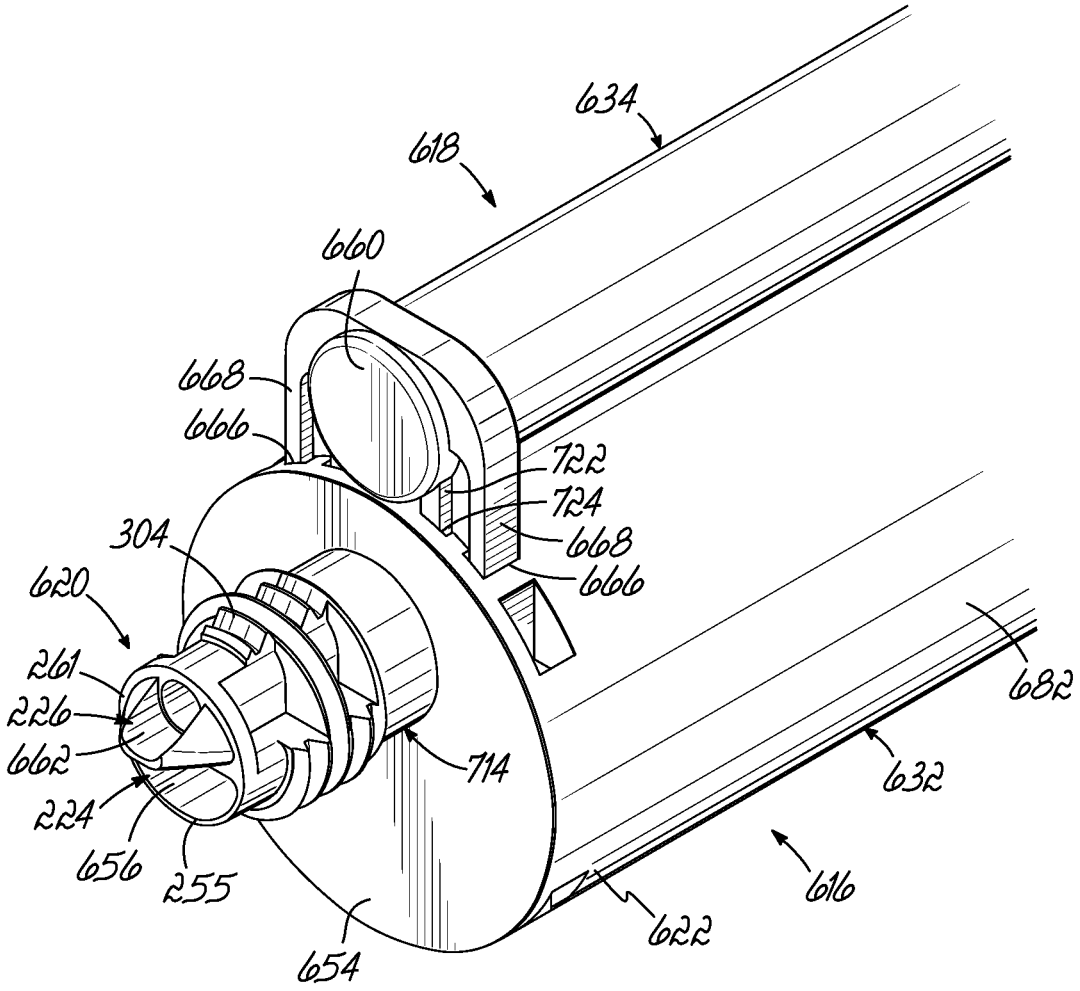
FIG. 9C is an enlarged perspective view of the multi-component cartridge assembly shown in FIG. 9A.
Figure 11:
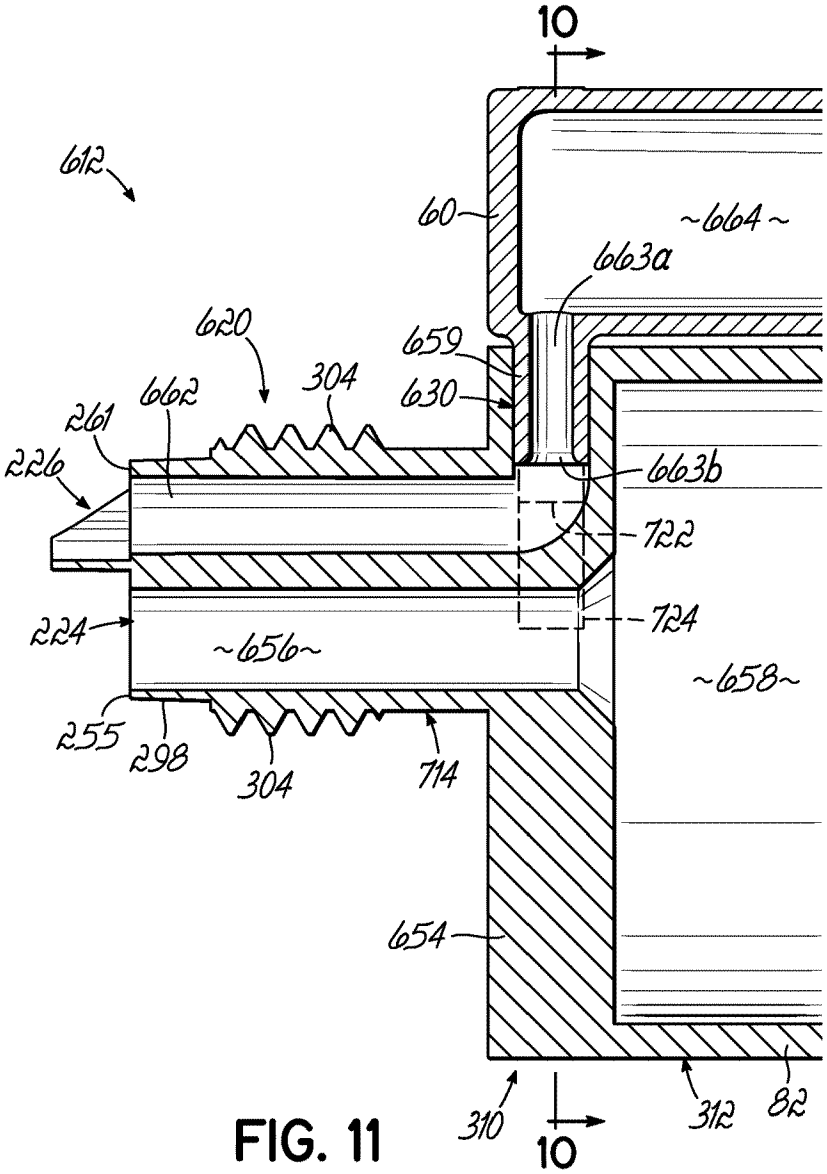
FIG. 11 is an axial cross-section view of the multi-component cartridge assembly shown in FIG. 9C.
Figure 10:
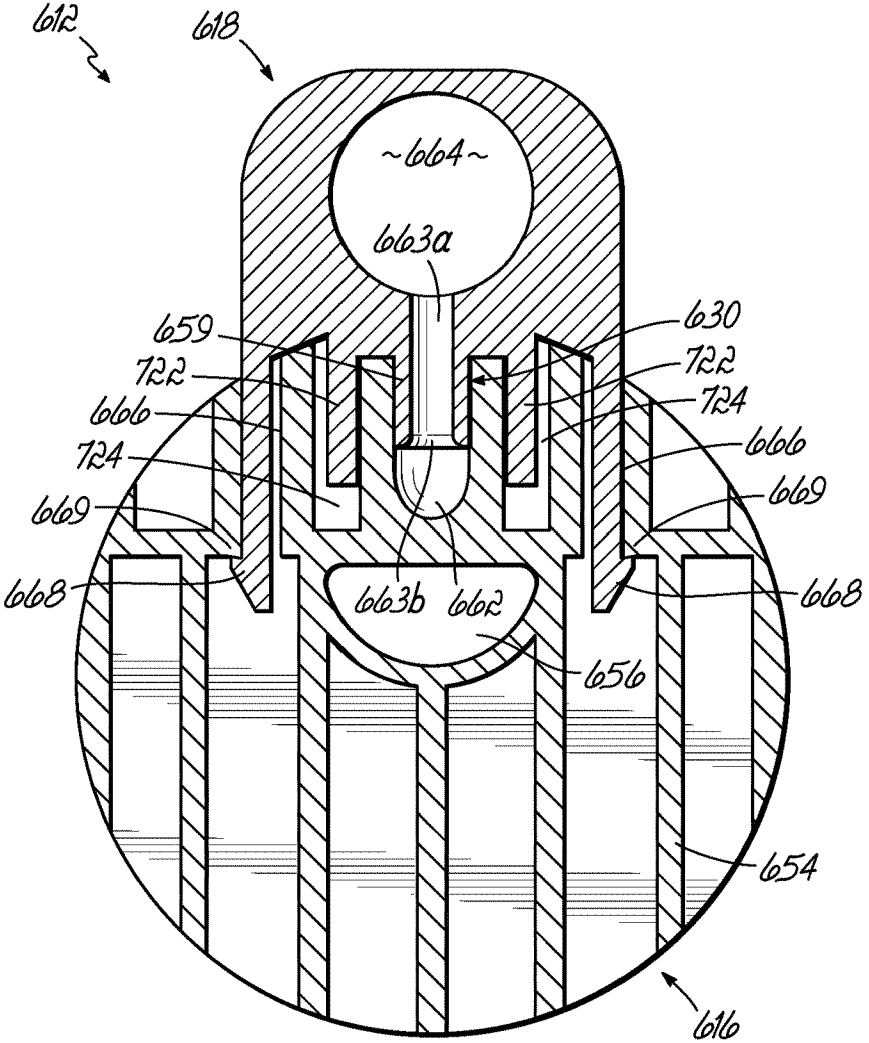
FIG. 10 is a cross-section view of the multi-component cartridge assembly taken along section line 10-10 of FIG. 11.

The activator stem 659 fluidly connects to the neck body 714 to form the neck 620 as shown in FIG. 9C and FIG. 11. The resin and activator neck ends 255, 261 are integral and unitarily formed with the neck body 714 for connecting to the nozzle 52 (see FIG. 1). The annular sealing surface 298 circumscribes the outer surface of the neck body 714 adjacent to the resin and activator neck ends 255, 261. The neck body 714 also includes the plurality of neck threads 304 for receiving the nozzle 52 (see FIG. 1) and dispensing the fluid resin and fluid activator components.

In order to secure the activator stem 659 within the activator neck inlet 665, the operator selectively interlocks the resin cartridge coupling element 666 with the activator cartridge coupling element 668. As shown in FIGS. 9A through 11, the resin cartridge 616 includes a pair of the resin cartridge coupling elements 666 in the form of a pair of snap channels 666 extending through the proximal wall 654 of the resin cartridge 616 and opening to the annular sidewall 682. The activator cartridge 618 includes a pair of activator cartridge coupling elements 668 is in the form of a pair of elongated snaps 668 extending transversely from the annular sidewall 684 of the activator cartridge 618. The snap channels 666 respectively receive the elongated snaps 668 such that the elongated snaps 668 interlock respectively with a pair of shoulders 669 within the proximal wall 654 of the resin cartridge 616. The elongated snaps 668 resiliently bend over the shoulders 669 in order to snap into the snap channels 666 and engage the shoulders 669 to secure the resin cartridge 616 against the activator cartridge 618.

The dispensing end portion 622 of the activator cartridge 618 also includes a pair of dowels 722. The dowels 722 are offset from each other, generally aligned parallel with the elongated snaps 668, and respectively positioned between the activator stem 659 and the elongated snaps 668. In turn, the dispensing end portion 622 of resin cartridge 616 includes a pair of dowel channels 724 to respectively receive the dowels 722. The dowel channels 724 generally align with the snap channels 666 and project adjacent to the activator neck inlet 665 to correspond with the position of the dowels 722 on the activator cartridge 618. The dowel channels 724 receive the dowels 722 to improve and maintain alignment of the activator stem 659 with the activator neck inlet 665. It will be appreciated that alternative resin and activator cartridge coupling elements 666, 668 may be used for securing the resin cartridge 616 against the activator cartridge 618 in the side-by-side configuration.

In use, the operator stores a supply of resin cartridges 16 separately from a supply of the activator cartridge 18 to inhibit a premature reaction of the fluid activator component with the fluid resin component prior to forming the multi-component cartridge assembly 12 shown in FIGS. 1 through 5. The resin cartridges 16 may be stored vertically or horizontally within the storage bin (not shown). The resin neck portion 28 projects from the resin cartridge body 32 such that the resin neck portion 28 is positioned within the radial boundary or periphery 36 of the resin cartridge body 32. The operator may store the resin cartridges 16 more densely together, because each resin cartridge body 32 may be stored directly against other resin cartridge bodies 32. In other words, the resin neck portion 28 does not interfere with adjacently positioned resin cartridges 16, because the resin neck portion 28 does not extend transversely outward beyond the radial boundary or periphery 36. Furthermore, the resin cartridge body 32 is also cylindrical and configured to smoothly roll along a surface (not shown). For example, the operator may store the resin cartridges 16 horizontally such that the resin cartridges 16 may be gravity fed through the storage bin (not shown) to be provided to the operator.

The operator retrieves the resin and activator cartridges 16, 18 from storage and operatively connects the resin and activator neck portions 28, 30 to form the neck 20 and secure the resin cartridge body 32 against the activator cartridge body 34. Alternatively, additional structures, such as the manifold 310 (see FIG. 6A), may further form the neck 20. The resin and activator neck portions 28, 30 form the neck 20 such that the neck 20 threadably receives the nozzle 52. The dispensing applicator 14 cradles the multi-component cartridge assembly 12 and the drive rod 44 engages the resin piston 48 within the resin cartridge body 32. In turn, the fluid resin component and the fluid activator component discharge through the neck 20 and dispense from the nozzle 52 as the mixture of fluid resin and fluid activator components. While the exemplary embodiment described herein dispenses the mixture from the nozzle 52, the fluids may alternatively discharge through the neck 20 and be received by another structure or mechanism configured to provide for the flow of fluid therealong.

While the above description of using the multi-component cartridge assembly 12 is described with respect to the first embodiment of the multi-component cartridge assembly 12 shown in FIGS. 1 through 5. It will be appreciated that the second embodiment of the multi-component cartridge assembly 212, the third embodiment of the multi-component cartridge assembly 412, and the fourth embodiment of the multi-component cartridge assembly 612 may be similarly used. Therefore, the method of use described above generally applies to each of the embodiments shown in FIGS. 1 through 11.

More particularly, with respect to the first embodiment of the multi-component cartridge assembly 12 shown in FIGS. 1 through 5, the operator moves the resin cartridge 16 transversely toward the activator cartridge 18, as indicated by arrow 76. With respect to the distal end portion 70, the operator inserts the tab 72, into the slot 74. The annular sidewall 82 of the resin cartridge 16 captures the tab 72 to secure the resin and activator cartridges 16, 18 together at the distal end portion 70. With respect to the proximal end portion 22, the operator moves the resin abutment surface 90 against the activator abutment surface 92. The opposing neck snaps 68 of the activator neck portion 30 extend transversely to the resin neck portion 28 and snap into respective groove 66 of the resin neck portion 28. The resin neck portion 28 interlocks with the activator neck portion 30 to further secure the resin and activator cartridges 16, 18 at the proximal end portion 22. In addition, the resin partial sealing surface 94 abuts and fluidly seals against the activator partial sealing surface 96 to form the annular sealing surface 98 and collectively form the neck 20.

FIGS. 6A through 7 show the second embodiment of the multi-component cartridge assembly 212. The operator moves the resin cartridge 216 transversely toward the activator cartridge 218, as indicated by arrow 276. With respect to the distal end portion 70, the operator interlocks the tab 72 with the slot 74 as discussed above. With respect to the proximal end portion 222, the operator moves the manifold 312 axially toward and against the proximal walls 54, 60 of the resin and activator cartridges 216, 218. The manifold coupling elements 320 respectively receive the resin and activator cartridge coupling element 266, 268 such that the dispensing wall 316 interlocks with the resin and activator wall clips 266, 268. The skirt 318 of the manifold 310 also surrounds the proximal end portion 222 of the resin and activator cartridges 216, 218. The manifold 312 secures the resin cartridge 216 against the activator cartridge 218 at the proximal end portion 222. The resin and activator neck outlets 224, 226 fluidly connect to the resin and activator chambers 58, 64 to collectively from the neck 220 from the neck body 314, the resin stem 253, and the activator stem 259.

FIGS. 8A through 8C shows the third embodiment of the multi-component cartridge assembly 412. The operator moves the resin cartridge 416 transversely toward the activator cartridge 418, as indicated by arrow 276. With respect to the distal end portion 70, the operator interlocks the tab 72 with the slot 74 as discussed above (see FIG. 6A). With respect to the proximal end portion 422, the operator moves the cantilevered wall 468 of the activator cartridge 418 axially toward and against the proximal wall 54 of the resin cartridge 416. The slot 469 receives the widened t-shaped tab 466 of the resin cartridge 416 such that the cantilevered wall 468 interlocks with the widened t-shaped tab 466 to secure resin cartridge 416 against the activator cartridge 418. The resin neck outlet 224 also fluidly connects to the resin chamber 58 to collectively from the neck 420 from the neck body 314 and the resin stem 253.

FIGS. 9A through 11 shows the fourth embodiment of the multi-component cartridge assembly 612. The operator moves the resin cartridge 616 transversely toward the activator cartridge 618, as indicated by arrow 676. With respect to the distal end portion 670, the operator interlocks the elongated retaining claims 672 with the widened slot 674 similar to the activator and resin retaining elements 72, 74 discussed above (see FIG. 6A). With respect to the proximal end portion 622, the operator inserts the elongated snaps 668 of the activator cartridge 618 into respective snap channels 666. The snap channels 666 receive the elongated snaps 668 such that the elongated snaps 668 respectively interlock with the shoulders 669 to secure resin cartridge 616 against the activator cartridge 618. In addition, the dowel channels 724 receive the dowels 722, respectively, and the activator neck inlet 665 receives the activator stem 659. The activator neck outlet 226 also fluidly connects to the activator chamber 664 to collectively from the neck 620 from the neck body 714 and the activator stem 659.

While the present invention has been illustrated by the description of one or more embodiments thereof, and while the embodiments have been described in considerable detail, they are not intended to restrict or in any way limit the scope of the appended claims to such detail. The various features shown and described herein may be used alone or in any combination. Additional advantages and modifications will readily appear to those skilled in the art. The invention in its broader aspects is therefore not limited to the specific details, representative apparatus and method and illustrative examples shown and described. Accordingly, departures may be from such details without departing from the scope of the general inventive concept.

What is claimed is:

1. A side-by-side cartridge assembly for dispensing a first fluid and a second fluid, the side-by-side cartridge assembly comprising:

a first cartridge having a first cartridge body, a first neck portion, and a first cartridge coupling element, said first cartridge body extending along an axial direction and having a first chamber configured to contain the first fluid, said first cartridge body having a first dispensing end portion and a radial boundary or periphery transverse to the axial direction, said first neck portion projecting from said first dispensing end portion of said first cartridge body and positioned within said radial boundary or periphery, said first neck portion further having at least a portion of a first outlet passage in fluid communication with said first chamber for discharging the first fluid therefrom, said first cartridge coupling element disposed at said first dispensing end portion and positioned within said radial boundary or periphery, wherein said first cartridge body is generally a first cylindrical cartridge body; and a second cartridge having a second cartridge body, a second neck portion, and a second cartridge coupling element, said second cartridge body having a second chamber configured to contain the second fluid, said second neck portion projecting from said second cartridge body and having at least a portion of a second outlet passage in fluid communication with said second chamber for discharging the second fluid therefrom, wherein said first and second cartridge coupling elements are configured to engage one another to operatively connect said first and second cartridges together such that said first neck portion is positioned proximate to said second neck portion to collectively form at least a portion of a neck for discharging the first fluid and the second fluid therefrom.

2. The side-by-side cartridge assembly of claim 1, wherein said radial boundary or periphery is a generally circular radial boundary or periphery, and said first neck portion is positioned within said generally circular radial boundary or periphery for allowing the first cylindrical cartridge body to smoothly roll along a surface.

3. A side-by-side cartridge assembly for dispensing a first fluid and a second fluid, the side-by-side cartridge assembly comprising:

a first cartridge having a first cartridge body, a first neck portion, a first dispensing end portion, and a first cartridge coupling element, said first cartridge body extending along an axial direction and having a first chamber configured to contain the first fluid, said first cartridge body having a radial boundary or periphery transverse to the axial direction, said first neck portion projecting from said first cartridge body and positioned within said radial boundary or periphery, said first neck portion extending from said first dispensing end portion to a first neck end, said first neck end having a first neck outlet in fluid communication with a first outlet passage for discharging the first fluid therefrom, said first neck portion further including said first cartridge coupling element; and a second cartridge having a second cartridge body, a second neck portion, a second dispensing end portion, and a second cartridge coupling element, said second cartridge body having a second chamber configured to contain the second fluid, said second neck portion extending from said second dispensing end portion to a second neck end, said second neck end having a second neck outlet in fluid communication with a second outlet passage for discharging the second fluid therefrom, and said second neck portion further including said second cartridge coupling element such that the second neck portion interlocks with the first neck portion via said first and second cartridge coupling elements such that said first neck portion is positioned proximate to said second neck portion to collectively form at least a portion of a neck for discharging the first fluid and the second fluid therefrom.

4. The side-by-side cartridge assembly of claim 3, wherein said first cartridge coupling element is a groove and said second cartridge coupling element is a neck snap, said neck snap interlocked with said groove for securing the first neck portion to the second neck portion.

5. The side-by-side cartridge assembly of claim 3, wherein said first neck portion has a first partial sealing surface and said second neck portion has a second partial sealing surface, and securing said first neck portion to said second neck portion abuts said first partial sealing surface against said second partial sealing surface such that said first and second partial sealing surfaces collectively form an annular sealing surface for fluidly sealing against a nozzle.

6. The side-by-side cartridge assembly of claim 1, wherein:

said second cartridge body includes a second dispensing end portion, said second neck portion is a neck body extending from said second dispensing end portion, said neck body having a first neck outlet and a second neck outlet, said second neck outlet in fluid communication with said second chamber via said second outlet passage extending therebetween, said second cartridge coupling element extends from said neck body of said second dispensing end portion to said first cartridge coupling element, and said second cartridge coupling element interlocks with said first cartridge coupling element such that said first neck outlet of said neck body is in fluid communication with said first chamber via said first outlet passage extending therebetween for further forming said neck and discharging the first and second fluids respectively therefrom.

7. The side-by-side cartridge assembly of claim 1, wherein:

said first neck portion is a neck body extending from said first dispensing end portion, said neck body having a first neck outlet and a second neck outlet, said first neck outlet in fluid communication with said first chamber via said first outlet passage extending therebetween, said second cartridge body includes a second dispensing end portion, said second cartridge coupling element extends from said second dispensing end portion to said first cartridge coupling element, and said second cartridge coupling element interlocks with said first cartridge coupling element such that said second neck outlet of said neck body is in fluid communication with said second chamber via said second outlet passage extending therebetween for further forming said neck and discharging the first and second fluids respectively therefrom.

8. The side-by-side cartridge assembly of claim 7, wherein said first cartridge coupling element is a channel defined by said first dispensing end portion of said first cartridge, said second cartridge coupling element is an elongate snap extending from said second dispensing end portion of said second cartridge.

9. The side-by-side cartridge assembly of claim 7, wherein:

said first dispensing end portion has a neck inlet fluidly connected to said second neck outlet via said second outlet passage extending therebetween, said neck inlet extending generally transverse to the second outlet passage for fluid communication therebetween; and said second neck portion has a conduit in fluid communication with said second chamber and extending from said second cartridge such that said conduit fluidly connects to said neck inlet for further defining the second outlet passage when said second cartridge coupling element interlocks with said first cartridge coupling element.

10. A cartridge for dispensing a first fluid from a side-by-side cartridge assembly, the cartridge comprising:

a first cartridge body and a first neck portion, said first cartridge body extending along an axial direction and having a first chamber configured to contain the first fluid, said first cartridge body having a first dispensing end portion and a radial boundary or periphery transverse to said axial direction, said first neck portion projecting from said first dispensing end portion of said first cartridge body and within said radial boundary or periphery, said first neck portion having at least a portion of a first outlet passage in fluid communication with said first chamber for discharging the first fluid therefrom, wherein said first cartridge body is generally a first cylindrical cartridge body; and a first cartridge coupling element disposed at said first dispensing end portion, positioned within said radial boundary or periphery, and configured to engage with a second cartridge coupling element of a second cartridge body of another cartridge to operatively connect said first neck portion to a second cartridge body of the other cartridge such that said first neck portion is configured to be positioned proximate to said second neck portion of the other cartridge for collectively forming at least a portion of a neck that discharges the first fluid therethrough.

11. The cartridge of claim 10, wherein said radial boundary or periphery is a generally circular radial boundary or periphery, and said first neck portion is positioned within said generally circular radial boundary or periphery such that said first cartridge body is configured to smoothly roll along a surface.

12. A cartridge for dispensing a first fluid from a side-by-side cartridge assembly, the cartridge comprising:

a first neck portion and a first cartridge body having a first dispensing end portion, said first cartridge body extending along an axial direction and having a first chamber configured to contain the first fluid, said first cartridge body having a radial boundary or periphery transverse to said axial direction, said first neck portion extending from said first dispensing end portion to a first neck end and positioned within said radial boundary or periphery, said first neck end having a first neck outlet in fluid communication with a first outlet passage for discharging the first fluid therefrom, and said first neck portion further including a first cartridge coupling element configured to operatively connect said first cartridge body to a second cartridge body of another cartridge such that said first neck portion is configured to be positioned proximate to and interlocked with a second neck portion of the other cartridge via said first cartridge coupling element for collectively forming at least a portion of a neck for discharging the first fluid therefrom.

13. The cartridge of claim 12, wherein said first neck portion has a first partial sealing surface configured to abut against a second partial sealing surface of the second neck portion to form an annular sealing surface for fluidly sealing against a nozzle.

14. The cartridge of claim 10, wherein said first cartridge coupling element is a tab extending from said first dispensing end portion of said first cartridge body, and said tab is configured to engage a second cartridge coupling element of the other cartridge for further forming the neck and discharging the first fluid therefrom.

15. The cartridge of claim 10, wherein:

said first neck portion is a neck body extending from said first dispensing end portion, said neck body further defining said first outlet passage having a first neck outlet and at least a portion of a second outlet passage having a second neck outlet, said first neck outlet in fluid communication with said first chamber via said first outlet passage extending therebetween, and said first dispensing end portion has a neck inlet fluidly connected to said second neck outlet via said portion of said second outlet passage extending therebetween, said neck inlet extending generally transverse to the second neck outlet for fluid communication therebetween.

* * * * *